US007694614B2

(12) United States Patent
Hilgendorf

(10) Patent No.: US 7,694,614 B2
(45) Date of Patent: Apr. 13, 2010

(54) CASE CUTTER ASSEMBLY

(75) Inventor: Dennis J. Hilgendorf, Stoughton, WI (US)

(73) Assignee: Walgreen, Co, Deerfield, IL (US)

( * ) Notice: Subject to any disclaimer, the term of this patent is extended or adjusted under 35 U.S.C. 154(b) by 0 days.

(21) Appl. No.: 11/400,985

(22) Filed: Apr. 10, 2006

(65) Prior Publication Data

US 2007/0125209 A1 Jun. 7, 2007

Related U.S. Application Data

(60) Provisional application No. 60/741,414, filed on Dec. 1, 2005.

(51) Int. Cl.
*B26D 5/20* (2006.01)

(52) U.S. Cl. ..... 83/367; 83/368; 83/403.1

(58) Field of Classification Search ..... 83/368, 83/370, 155, 367, 369, 403.1; 53/381.2; 198/460.1, 459.8
See application file for complete search history.

(56) References Cited

U.S. PATENT DOCUMENTS 3,485,339 A * 12/1969 Lowell et al. ..... 198/460.1
3,668,821 A * 6/1972 Benson et al. ..... 53/517
3,922,778 A * 12/1975 Aalpoel ..... 30/2
3,937,342 A * 2/1976 Ittner et al. ..... 414/411
4,291,518 A * 9/1981 Johnson ..... 53/491
4,514,963 A * 5/1985 Bruno ..... 53/493
4,610,596 A 9/1986 Bouldin et al.
4,835,836 A 6/1989 Van Uitert
5,011,467 A 4/1991 Traegaardh
5,048,267 A 9/1991 Kudo et al.
5,059,082 A 10/1991 Tanttu et al.
5,101,703 A * 4/1992 Tanaka et al. ..... 83/880
5,144,789 A 9/1992 Focke et al.
5,454,683 A 10/1995 Marom et al.
5,649,801 A 7/1997 White
5,862,907 A * 1/1999 Taylor ..... 198/781.05
6,189,298 B1 * 2/2001 Kuji et al. ..... 53/492
6,629,593 B2 * 10/2003 Zeitler ..... 198/460.1
6,694,852 B1 2/2004 Ours et al.
6,725,631 B2 4/2004 Skrak et al.
6,725,752 B1 4/2004 Torrazza (Continued)

OTHER PUBLICATIONS

"Case Cutter Boosts Productivity at Distribution Center," article reprinted from *Grocery Distribution Magazine*, Feb. 18, 2004.

*Primary Examiner*—Stephen Choi
(74) *Attorney, Agent, or Firm*—Banner & Witcoff, Ltd.; Francis C. Kowalik, Esq.

(57) ABSTRACT

A case cutter apparatus for cutting a container has a conveyor for moving the container in a single direction, a measuring device measuring a length, a width, and a height of the container, a controller for controlling the apparatus and for receiving information from the measuring device, and a first cutting assembly and a second cutting assembly positioned along the conveyor. The first cutting assembly includes an indexing assembly holding the container in a predetermined position during cutting, a carriage moveable in a cutting direction transverse to the direction of the conveyor, and two cutting blades attached to the carriage. The second cutting assembly includes two belts each having a cleat thereon for pushing the container through the second cutting assembly in the direction of the conveyor, and two cutting blades.

18 Claims, 45 Drawing Sheets

U.S. PATENT DOCUMENTS

| | | | | |
|---|---|---|---|---|
| 6,863,486 | B2 | 3/2005 | Ours et al. | |
| 7,174,695 | B2 * | 2/2007 | Porter et al. | 53/381.2 |
| 2002/0162302 | A1 | 11/2002 | Thomson et al. | |
| 2003/0150695 | A1 * | 8/2003 | Cotter et al. | 198/460.1 |
| 2004/0194428 | A1 * | 10/2004 | Close et al. | 53/381.2 |
| 2004/0250670 | A1 | 12/2004 | Porter et al. | |

* cited by examiner

114

91
90
89
93
91a
90a
93a
90b
91b

CASE CUTTER ASSEMBLY

CROSS-REFERENCE TO RELATED APPLICATIONS

This application claims the benefit of and priority to U.S. Provisional Application Ser. No. 60/741,414, filed Dec. 1, 2005, which is incorporated by reference herein and made a part hereof.

TECHNICAL FIELD

The invention relates generally to a case cutter apparatus and method and, more specifically, to an automated machine that cuts a case or box wherein a top portion of the case can be easily removed.

BACKGROUND OF THE INVENTION

Case cutters are known in the art. Case cutters are typically used by entities needing to quickly open large quantities of boxes containing product inventory for further distribution. While case cutters according to the prior art provide a number of advantageous features, they nevertheless have certain limitations. For example, many case cutter designs lack adequate structure to cut a sufficient number of boxes within a prescribed period of time.

The present invention seeks to overcome certain of these limitations and other drawbacks of the prior art, and to provide advantages and aspects not provided by case cutters of the prior art. A full discussion of the features and advantages of the present invention is deferred to the following detailed description, which proceeds with reference to the accompanying drawings.

SUMMARY OF THE INVENTION

The present invention provides a case cutter apparatus.

According to one aspect of the invention, the case cutter is used for cutting a container and has a conveyor for moving the container in a single direction, a measuring device measuring a length, a width, and a height of the container, a controller for controlling the apparatus and for receiving information from the measuring device, and a first cutting assembly and a second cutting assembly positioned along the conveyor.

According to another aspect of the invention, the first cutting assembly includes an indexing assembly holding the container in a predetermined position during cutting, a carriage moveable in a cutting direction transverse to the direction of the conveyor, and two cutting blades attached to the carriage.

According to another aspect of the invention, the second cutting assembly includes two belts each having a cleat thereon for pushing the container through the second cutting assembly in the direction of the conveyor, and two cutting blades.

According to another aspect of the invention, a container cut by the case cutter has lateral cut lines and longitudinal cut lines staggered from each other, forming a bridge. This cut container is configured for easy opening.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
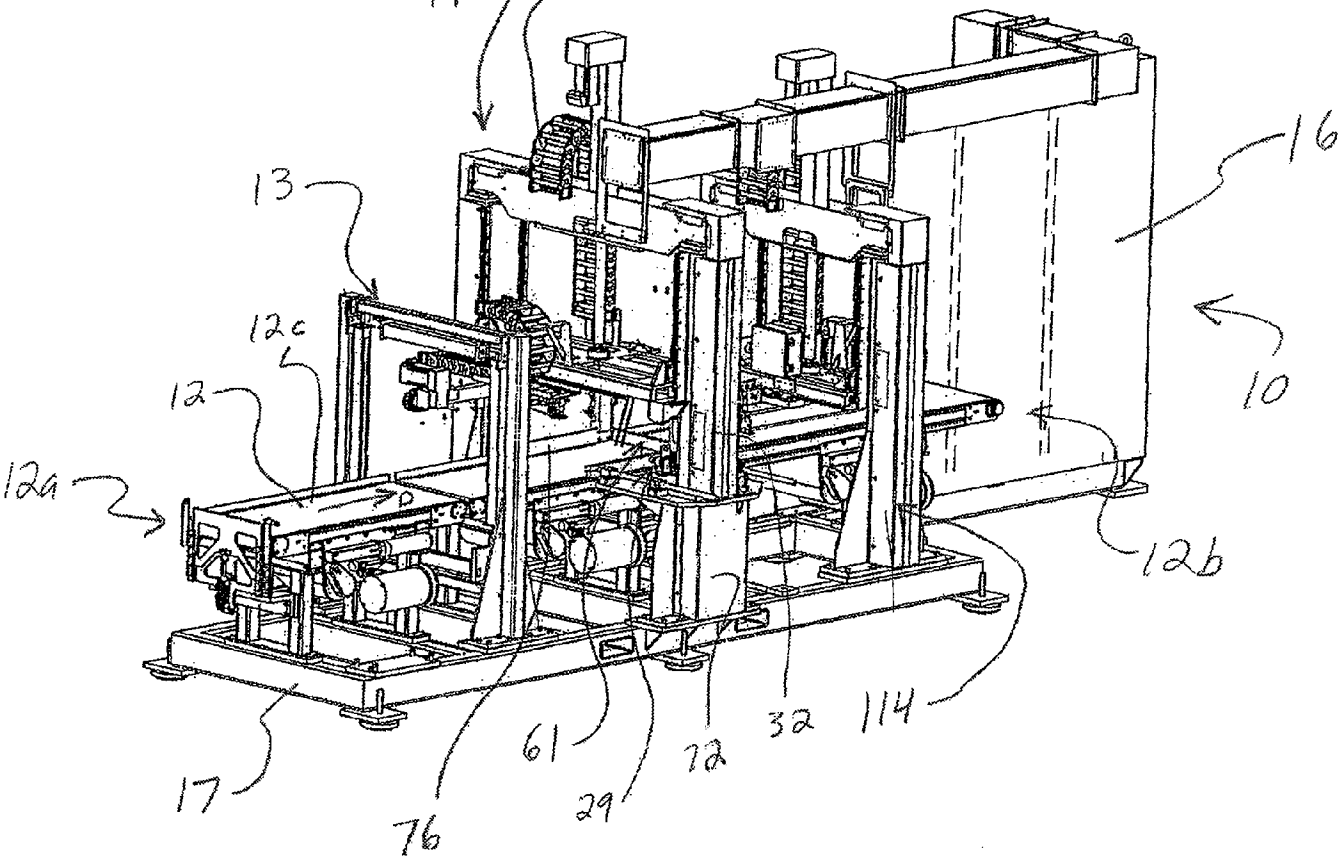
FIG. 1 is a perspective view of a case cutter apparatus of the present invention.
Figure 2:
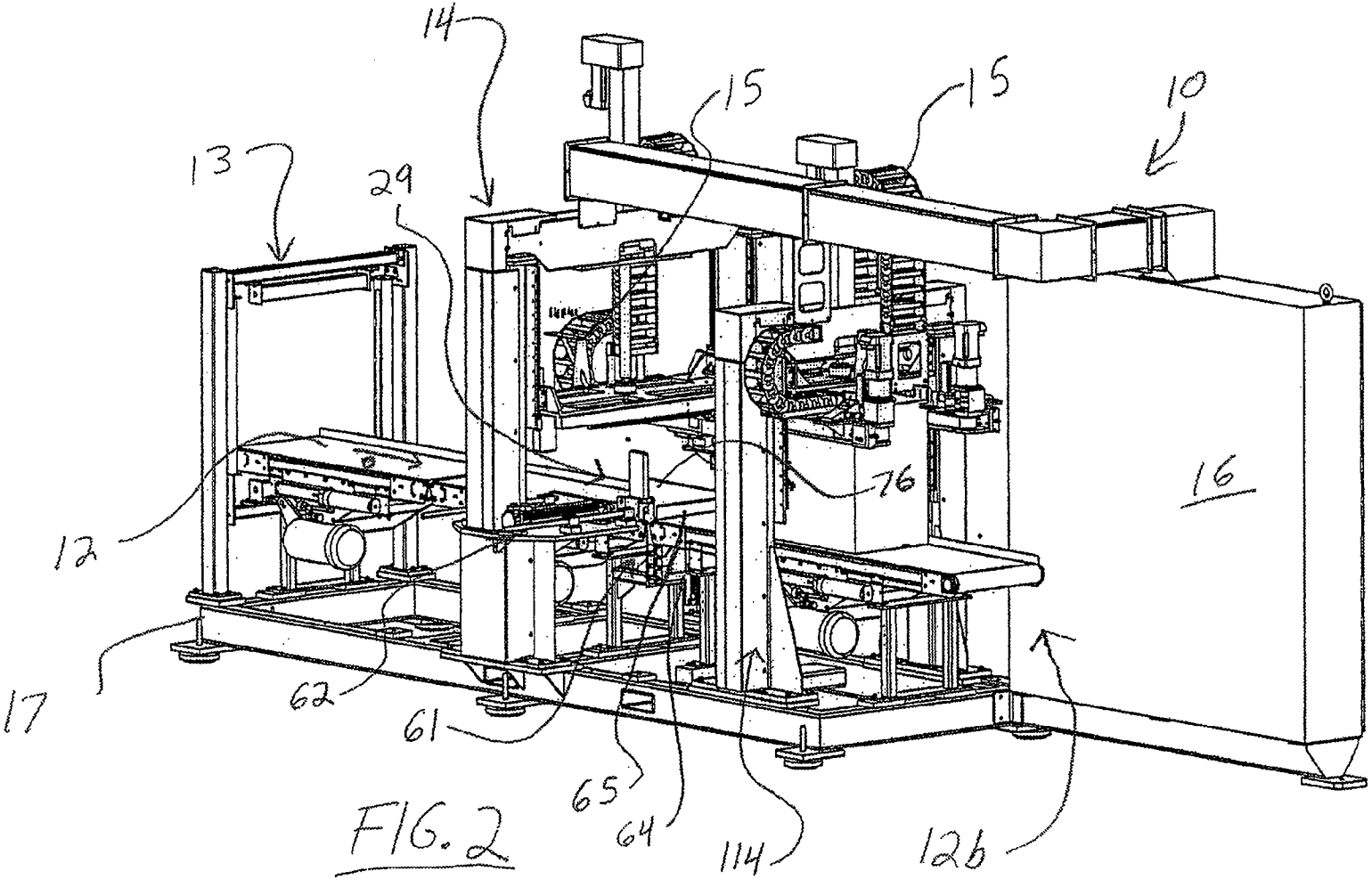
FIG. 2 is a rear perspective view of the case cutter apparatus of FIG. 1.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring in detail to the FIGS., and initially to FIGS. 1-4, a case cutter apparatus 10 is shown. The case cutter 10 is used for cutting closed cases or containers 11, most advantageously cardboard boxes, so the containers 11 are opened or can easily be opened by an operator. The case cutter 10 generally includes a conveyor 12, a measuring device 13, a first cutting assembly 14, a second cutting assembly 114, and a controller 16, all supported by a base frame 17.

Conveyors of all shapes and sizes are known in the art. The conveyor 12 of the present invention is used to move the containers 11 being cut through the case cutter 10, and is supported by the base frame 17. Closed containers 11 are loaded onto the top surface 12*c* of the conveyor 12 at a loading end 12*a* and cut containers 11 are unloaded from the conveyor 12 at an unloading end 12*b*. The preferred embodiment of the case cutter 10 uses a standard belt conveyor 12 of sufficient width to accommodate any normally used container 11. As illustrated in FIGS. 1-4, the conveyor 12 extends in only a single direction (D), and thus moves the container 11 in a single direction (D) and along a single axis of movement (D). In one embodiment, the conveyor 12 includes a loading platform (not shown) containing a track of rollers that leads to the loading end 12*a* of the conveyor 12, facilitating loading. The conveyor 12 may also include a similarly structured unloading platform (not shown) leading from the unloading end 12*b* of the conveyor 12.

Figure 41:
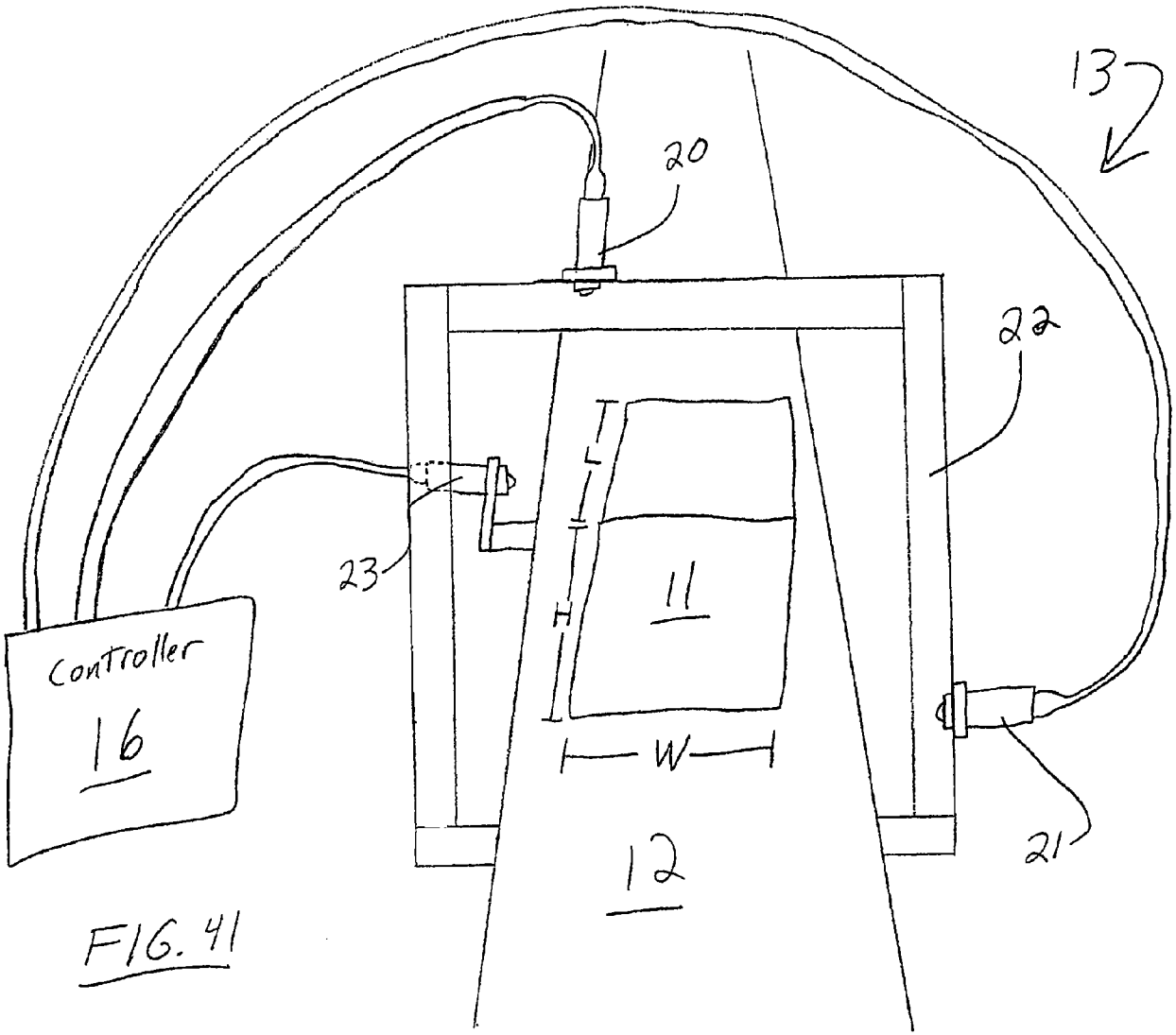
FIG. 41 is an isometric view of a measuring device of the case cutter apparatus of FIG. 1.
Figure 42:
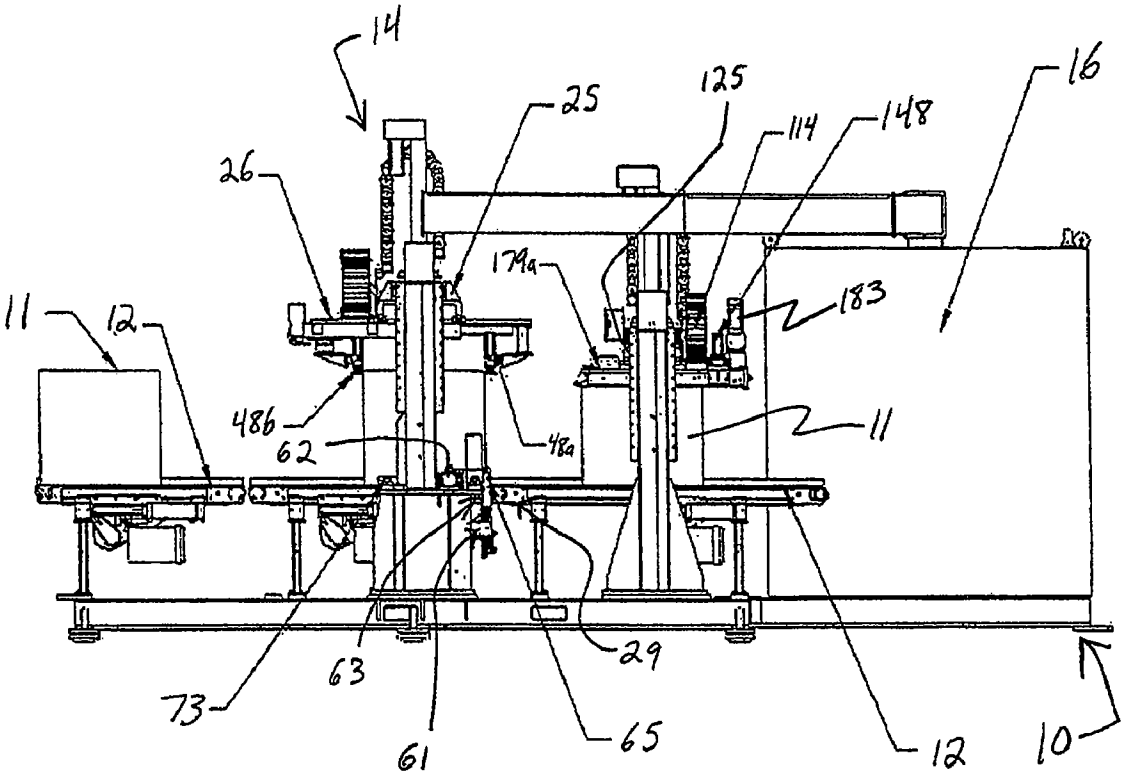
FIG. 42 is a side view of the case cutter apparatus of FIG. 1 processing containers of relatively large size.
Figure 43:
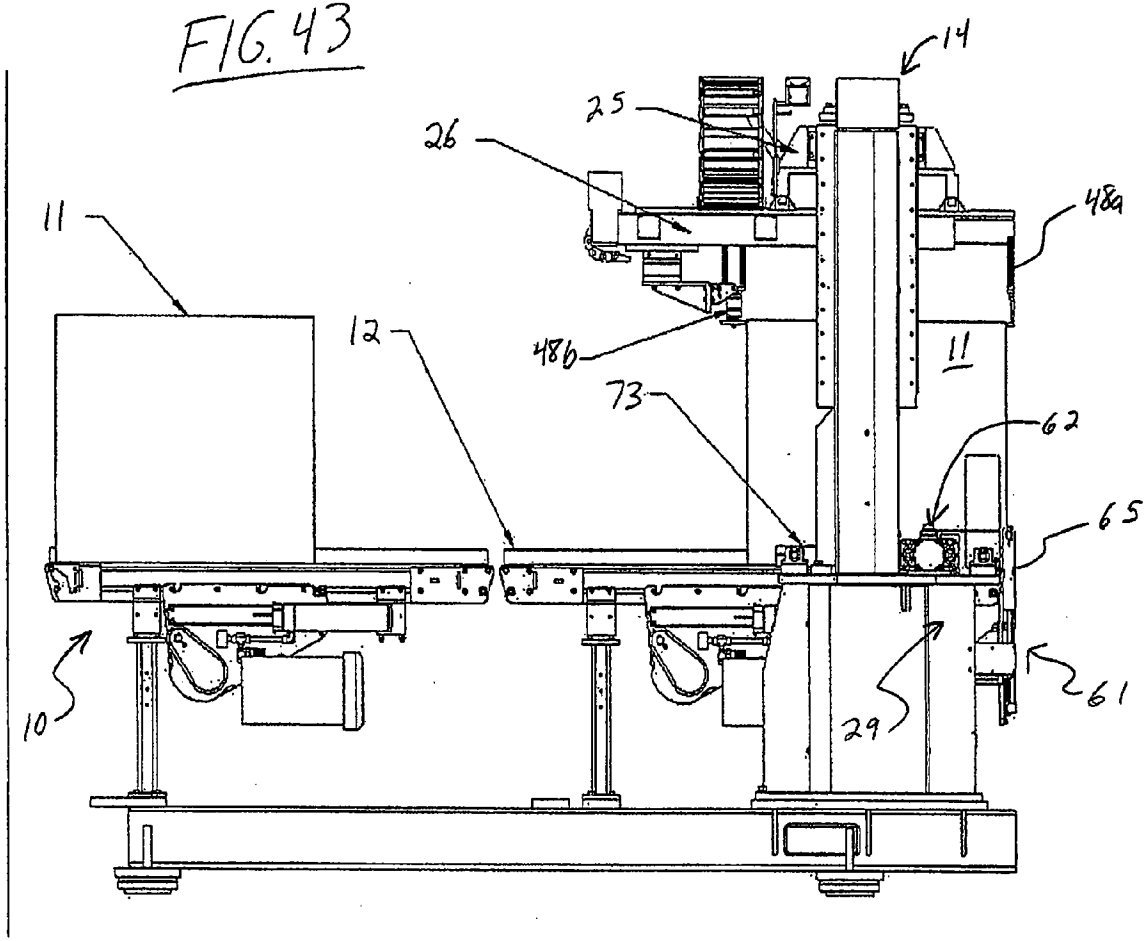
FIG. 43 is a focused side view of a portion of the case cutter apparatus and containers of FIG. 42.
Figure 44:
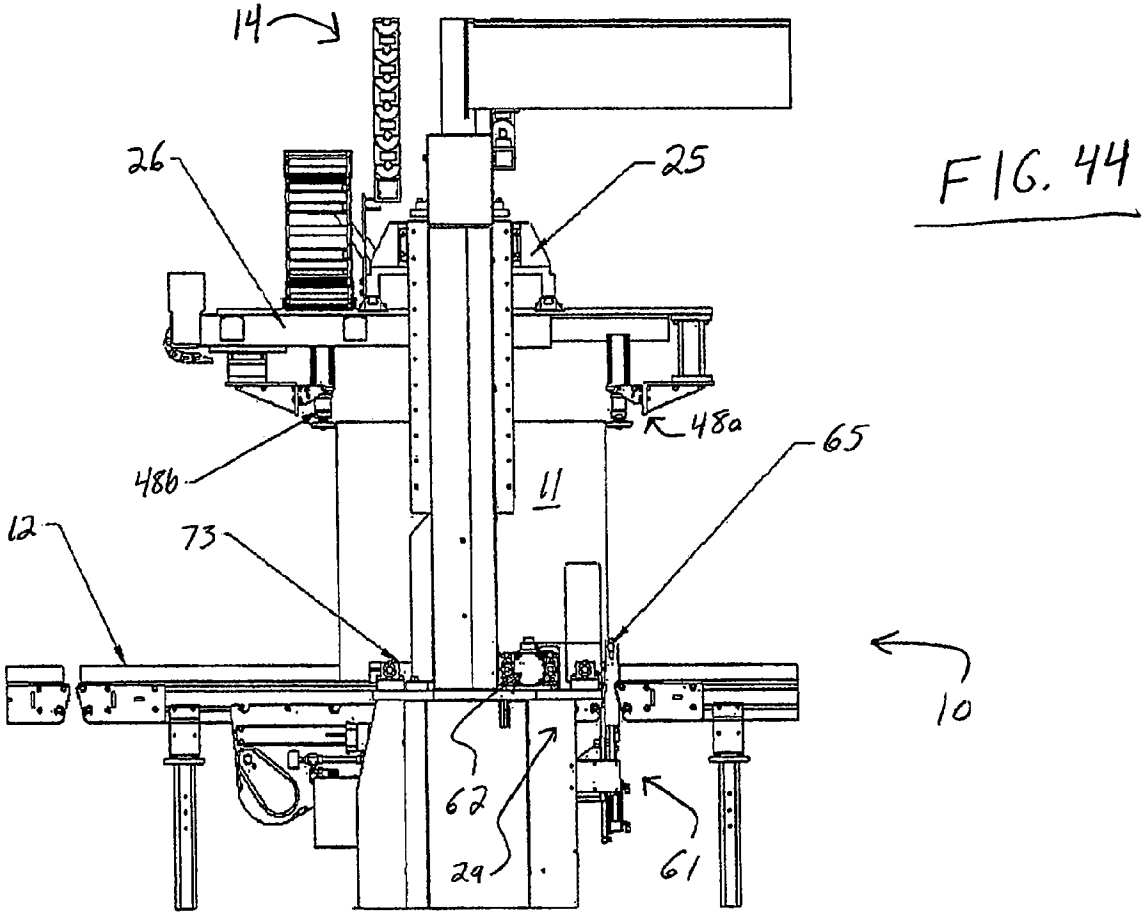
FIG. 44 is a focused side view of a portion of the case cutter apparatus and containers of FIG. 42, showing a first cutting assembly cutting a container.
Figure 45:
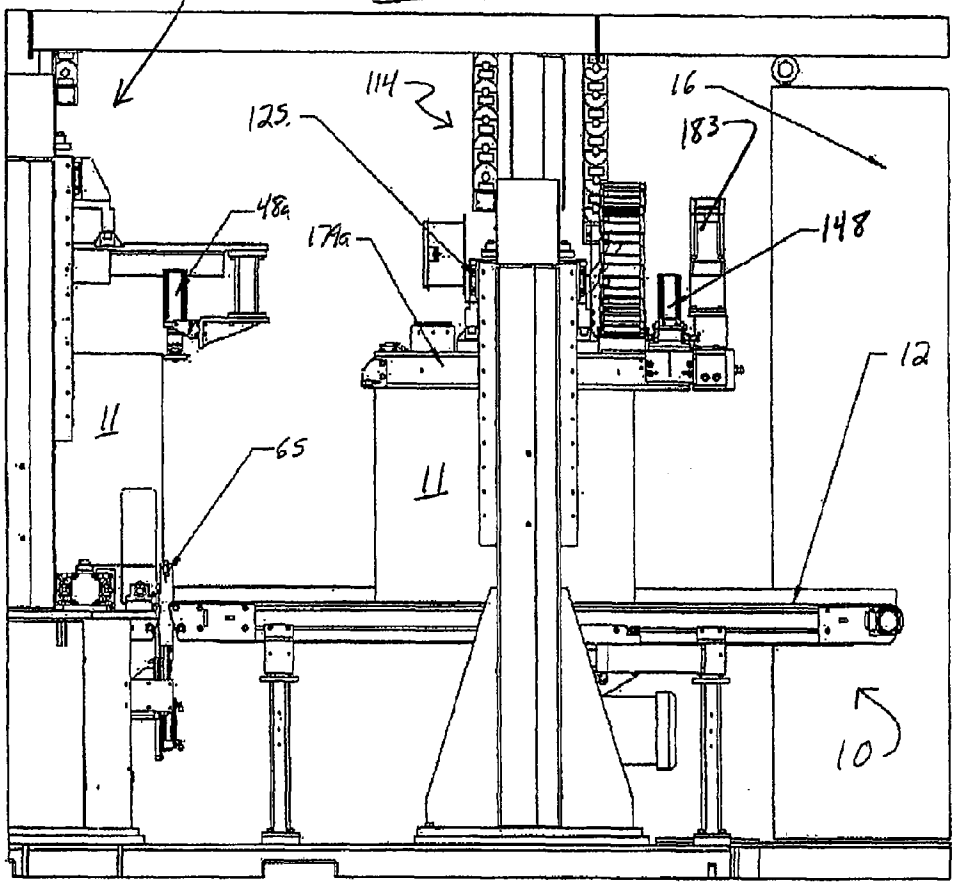
FIG. 45 is a focused side view of a portion of the case cutter apparatus and containers of FIG. 42, showing a second cutting assembly cutting a container.
Figure 46:
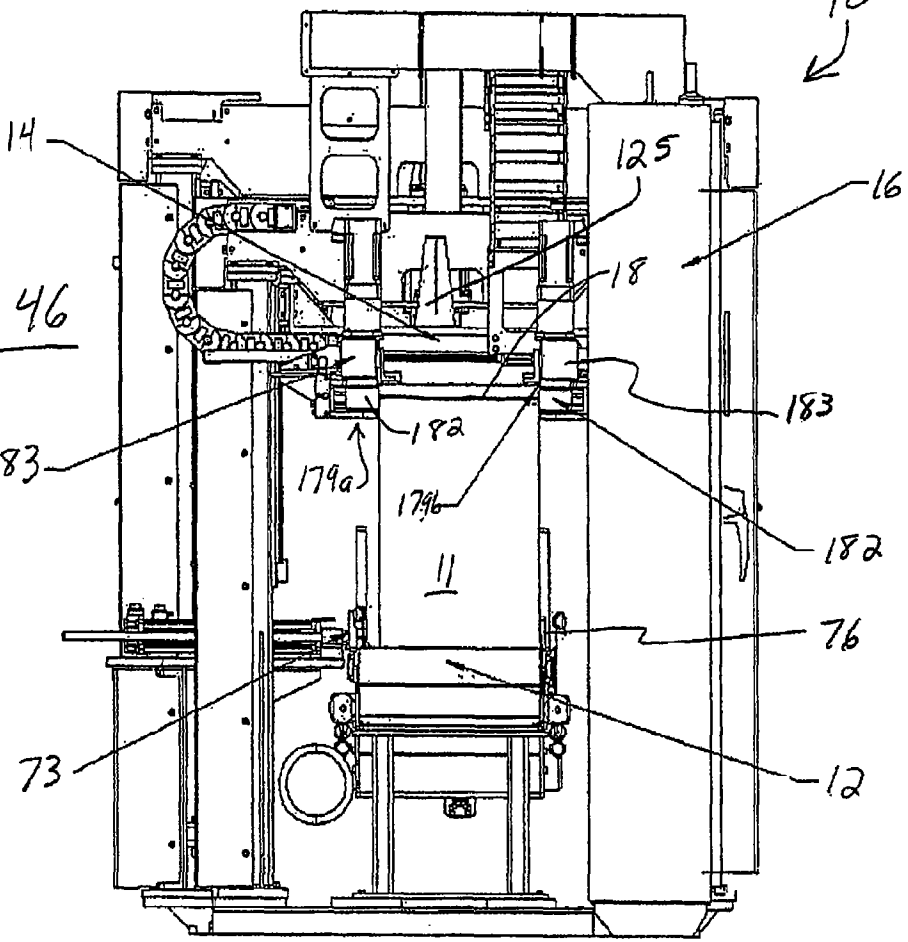
FIG. 46 is an end view of the second cutting assembly and container of the case cutter apparatus of FIG. 45.
Figure 47:
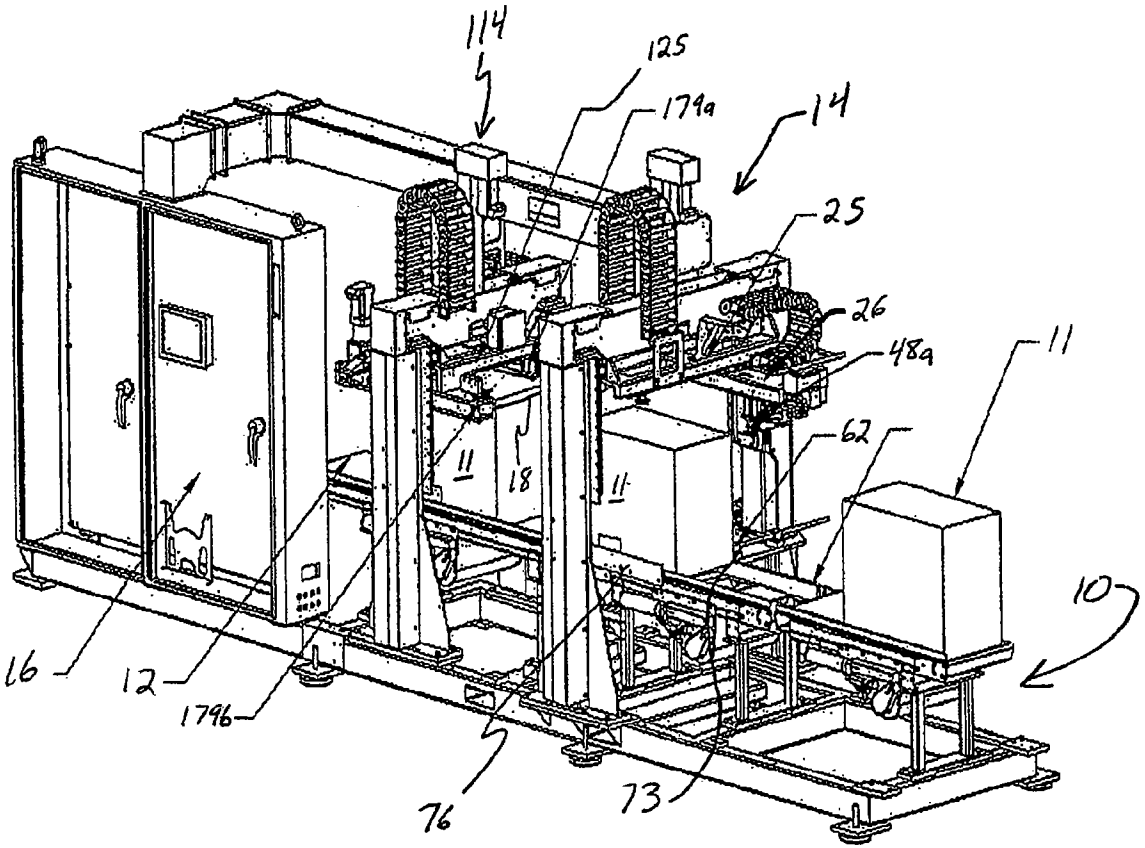
FIG. 47 is a perspective view of the case cutter apparatus and containers of FIG. 42.
Figure 48:
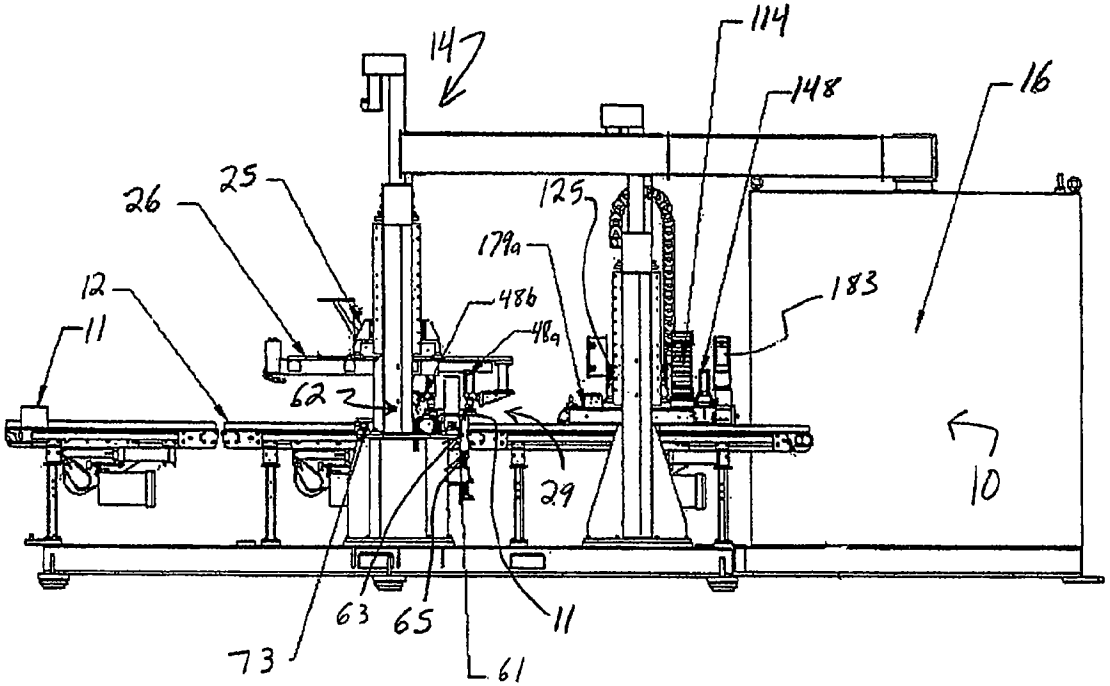
FIG. 48 is a side view of the case cutter apparatus of FIG. 1 processing containers of relatively small sizes.
Figure 49:
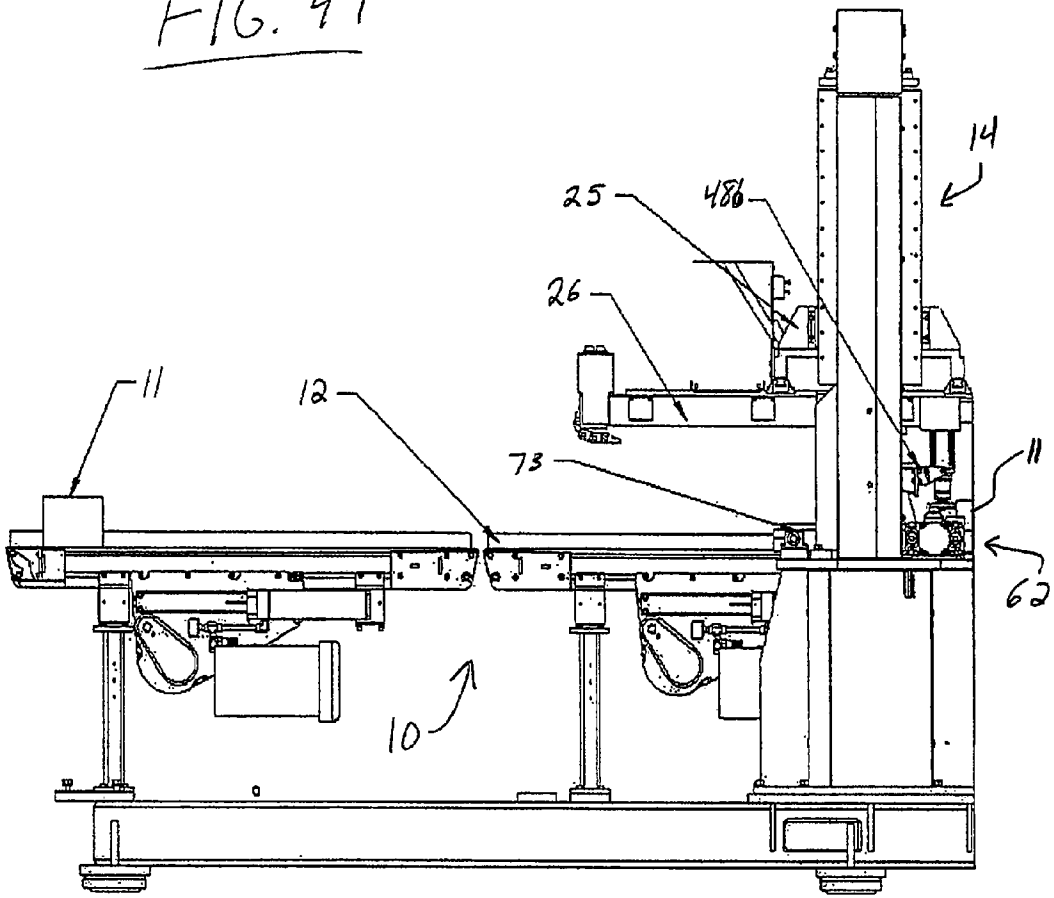
FIG. 49 is a focused side view of a portion of the case cutter apparatus and containers of FIG. 48.
Figure 50:
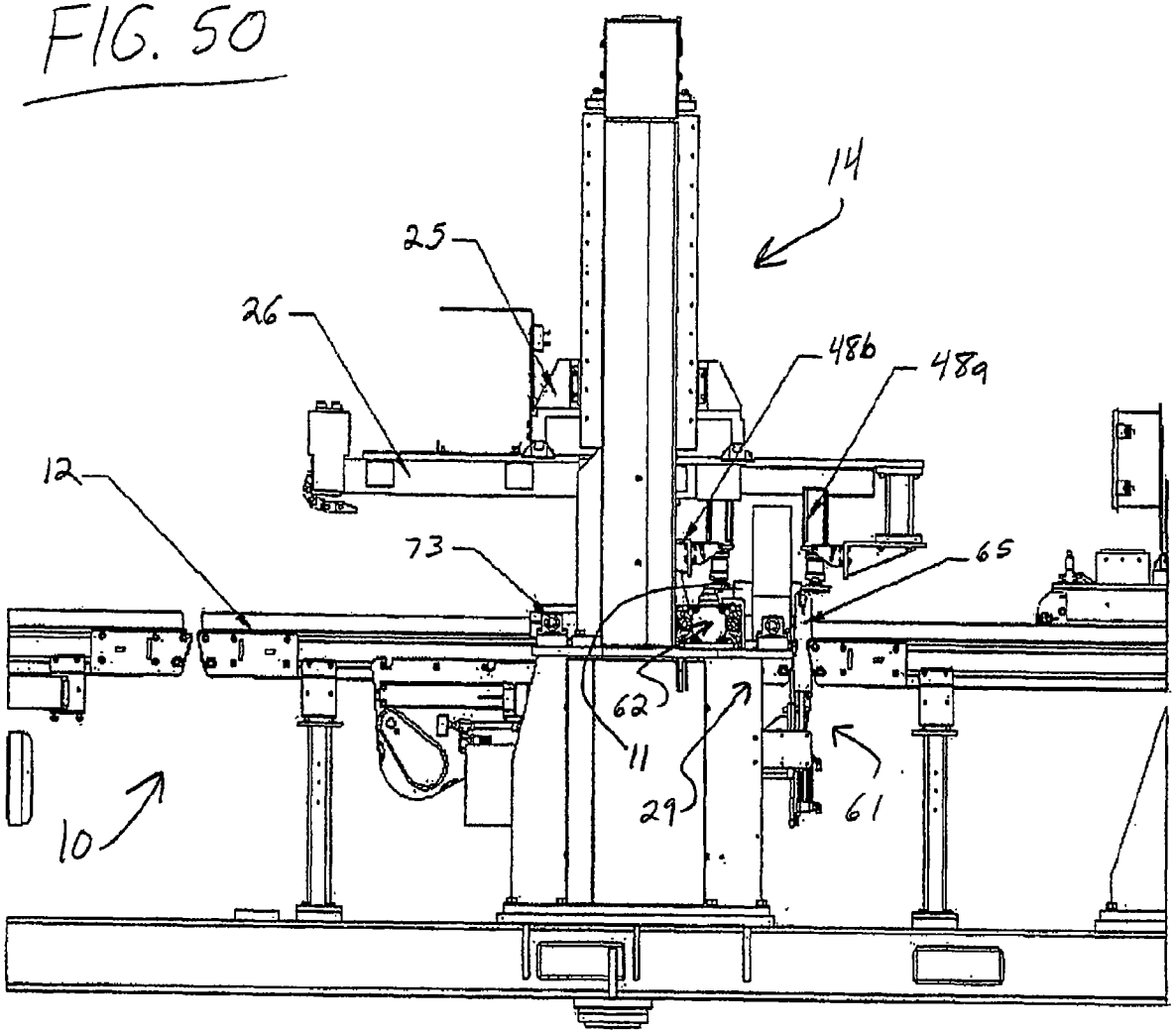
FIG. 50 is a focused side view of a portion of the case cutter apparatus and containers of FIG. 48, showing a first cutting assembly cutting a container.
Figure 51:
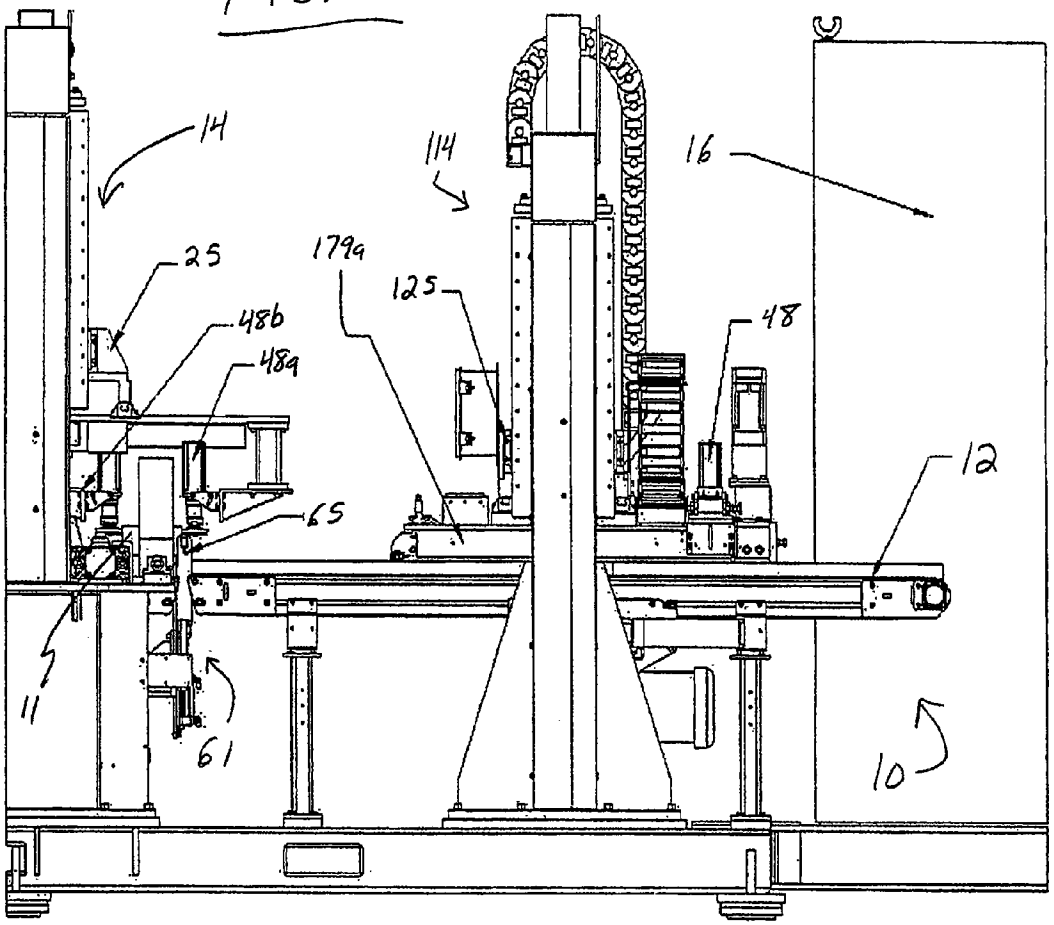
FIG. 51 is a focused side view of a portion of the case cutter apparatus and containers of FIG. 48, showing a second cutting assembly cutting a container.
Figure 52:
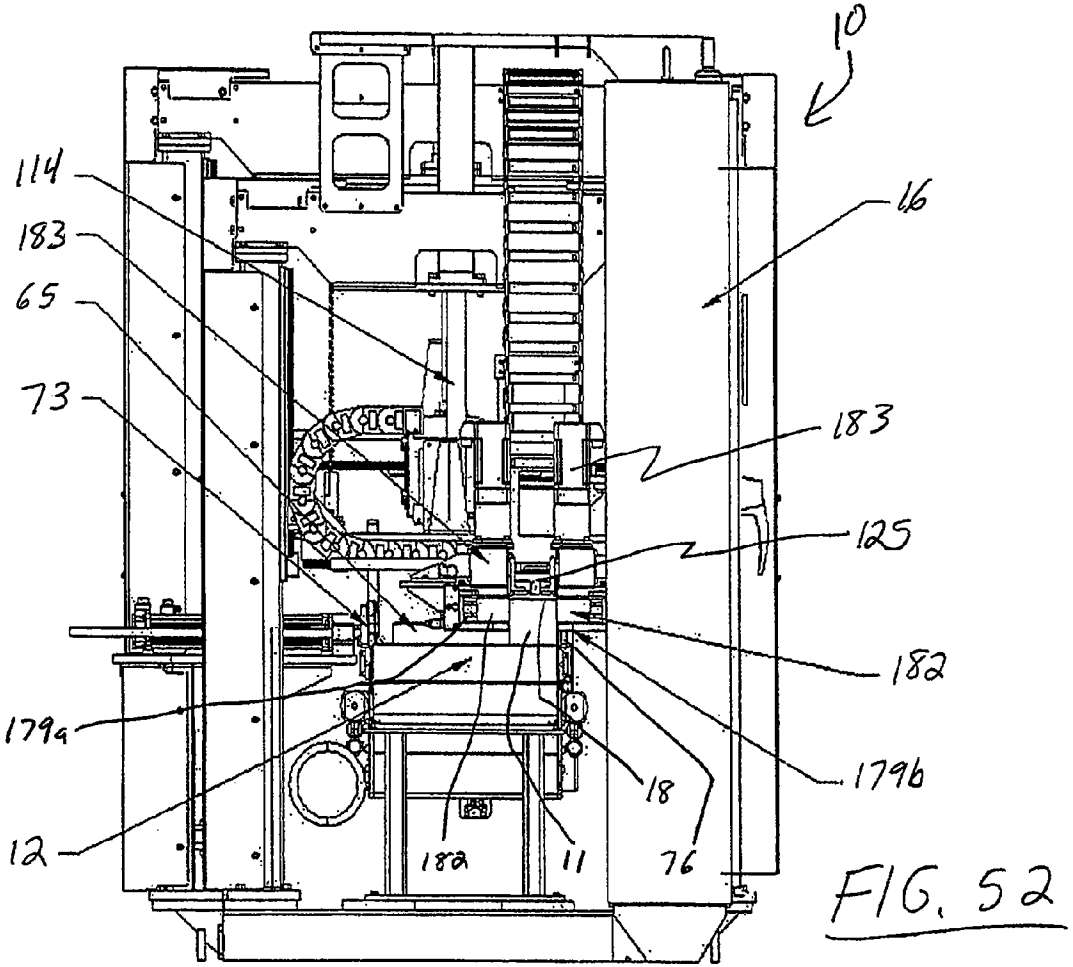
FIG. 52 is an end view of the second cutting assembly and container of the case cutter apparatus of FIG. 51.
Figure 53:
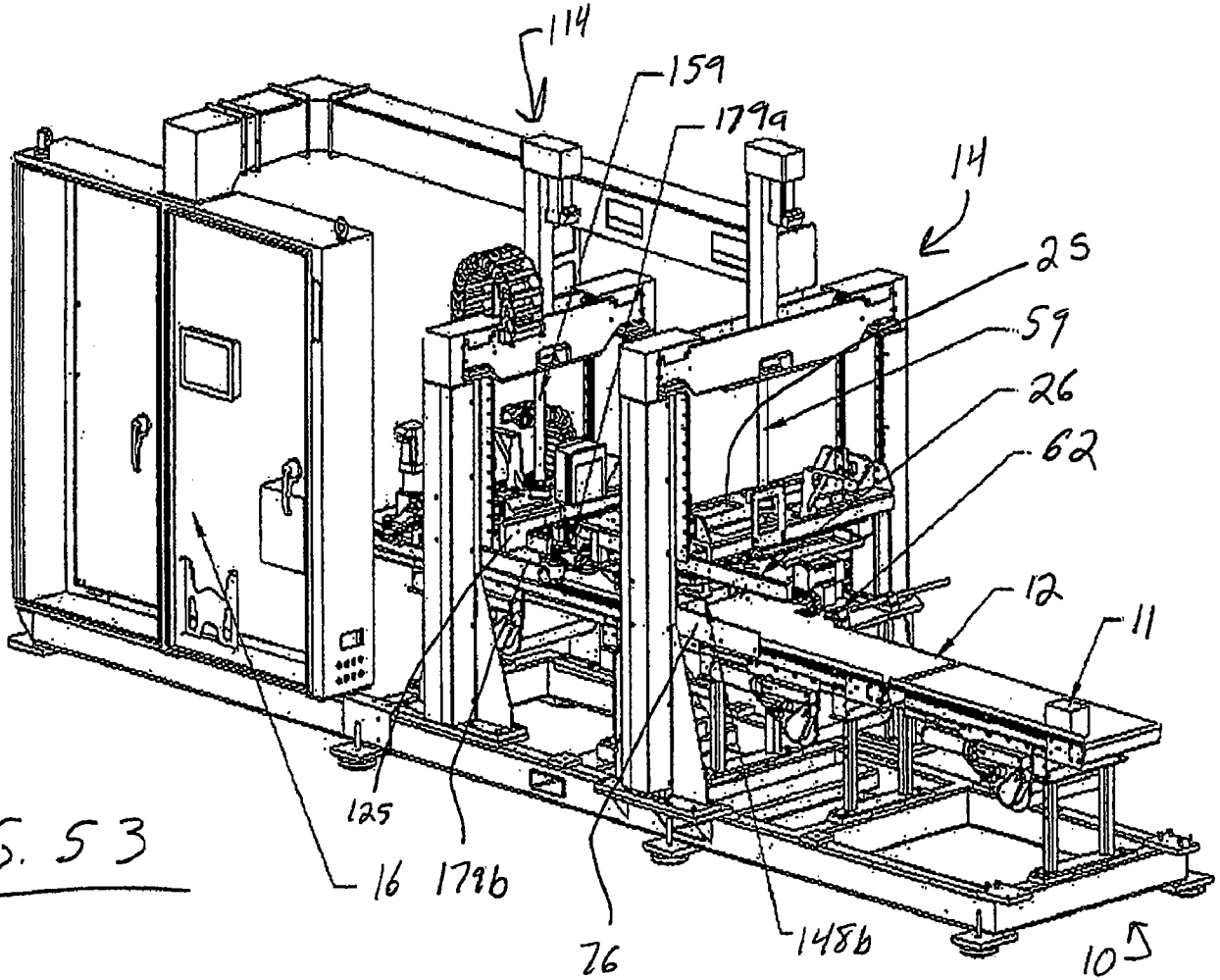
FIG. 53 is a perspective view of the case cutter apparatus and containers of FIG. 48.

The preferred embodiment of the case cutter 10 includes a measuring device 13 to measure the length (L), width (W), and height (H) of each container 11. The preferred measuring device 13 is shown in FIG. 41, and includes a width sensor 20 and a height sensor 21 mounted on a frame 22 and a length sensor 23 mounted slightly farther down the conveyor 12. The preferred embodiment utilizes sonic sensors for the width sensor 20 and the height sensor 21, but other types of sensors may be used, such as laser sensors or induction sensors. The preferred length sensor 23 is a reflective laser sensor, and other types of sensors may be used, such as sonic sensors or induction sensors. The length, width, and height measurements of each container 11 are transmitted to the controller 16, which, through an operative connection, adjusts the components of the case cutter 10 appropriately for that particular container 11.

Figure 5:
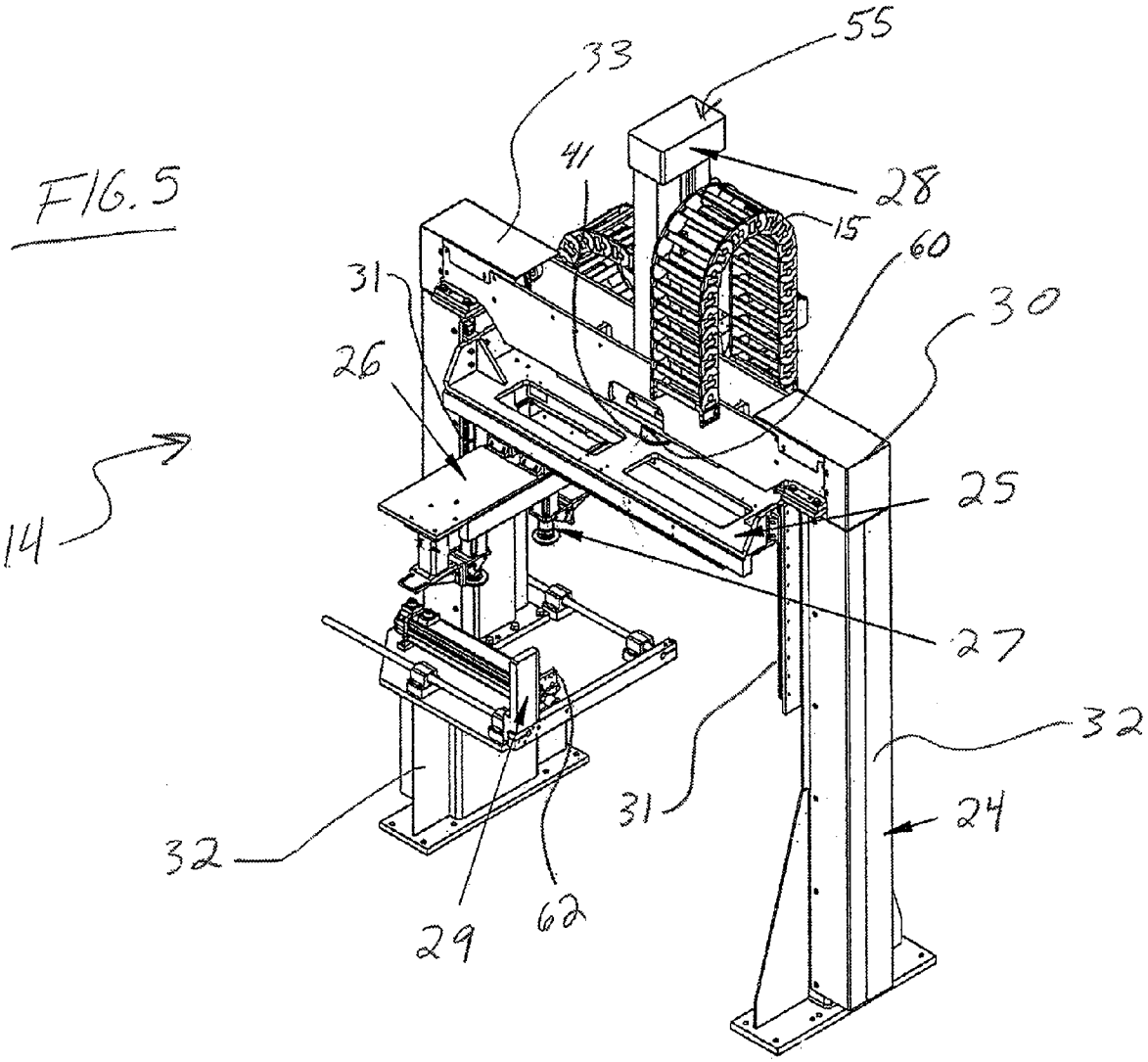
FIG. 5 is a rear perspective view of a first cutting assembly of the case cutter apparatus of FIG. 1.
Figure 6:
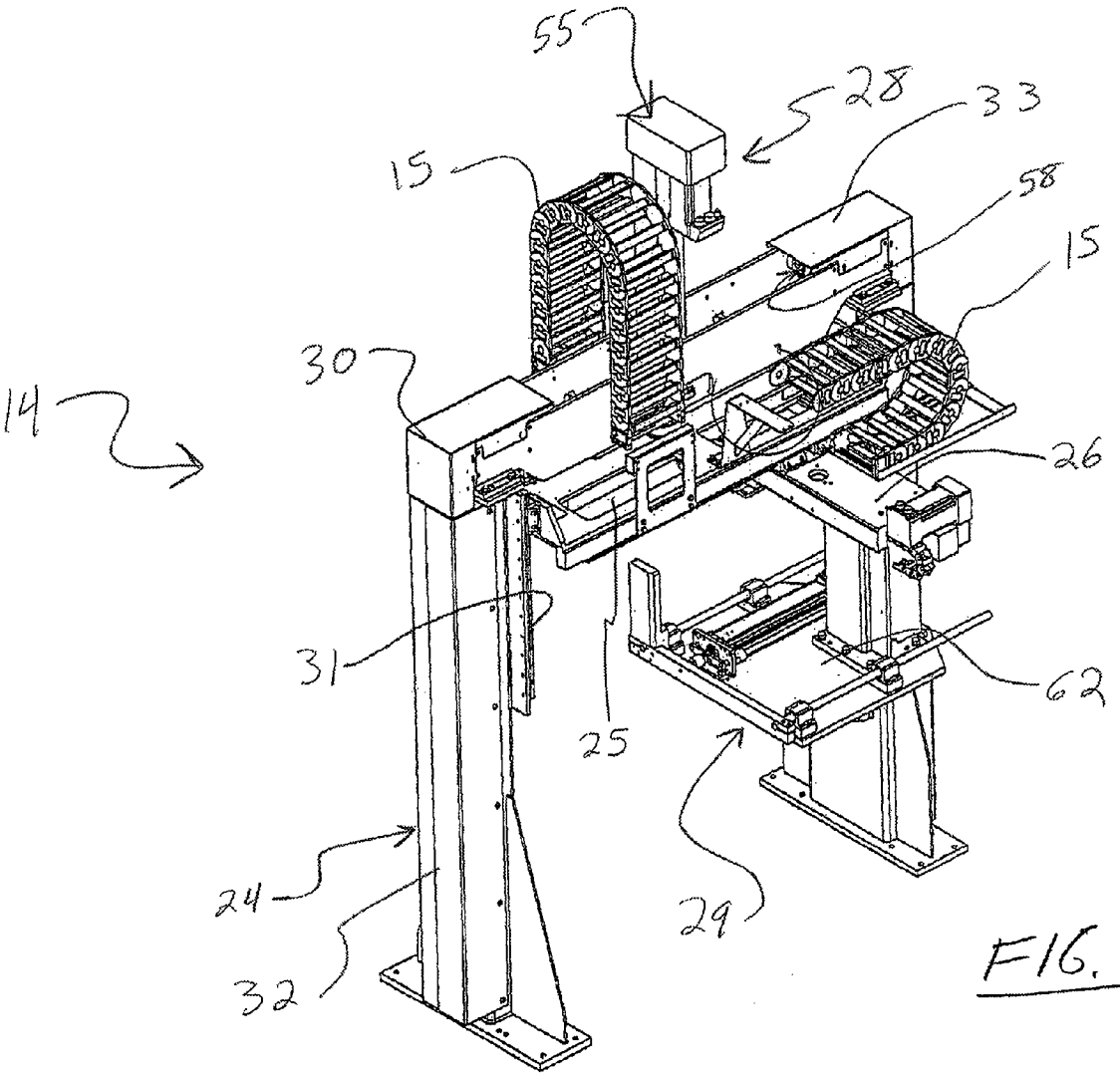
FIG. 6 is a front perspective view of the first cutting assembly of FIG. 5.
Figure 6A:
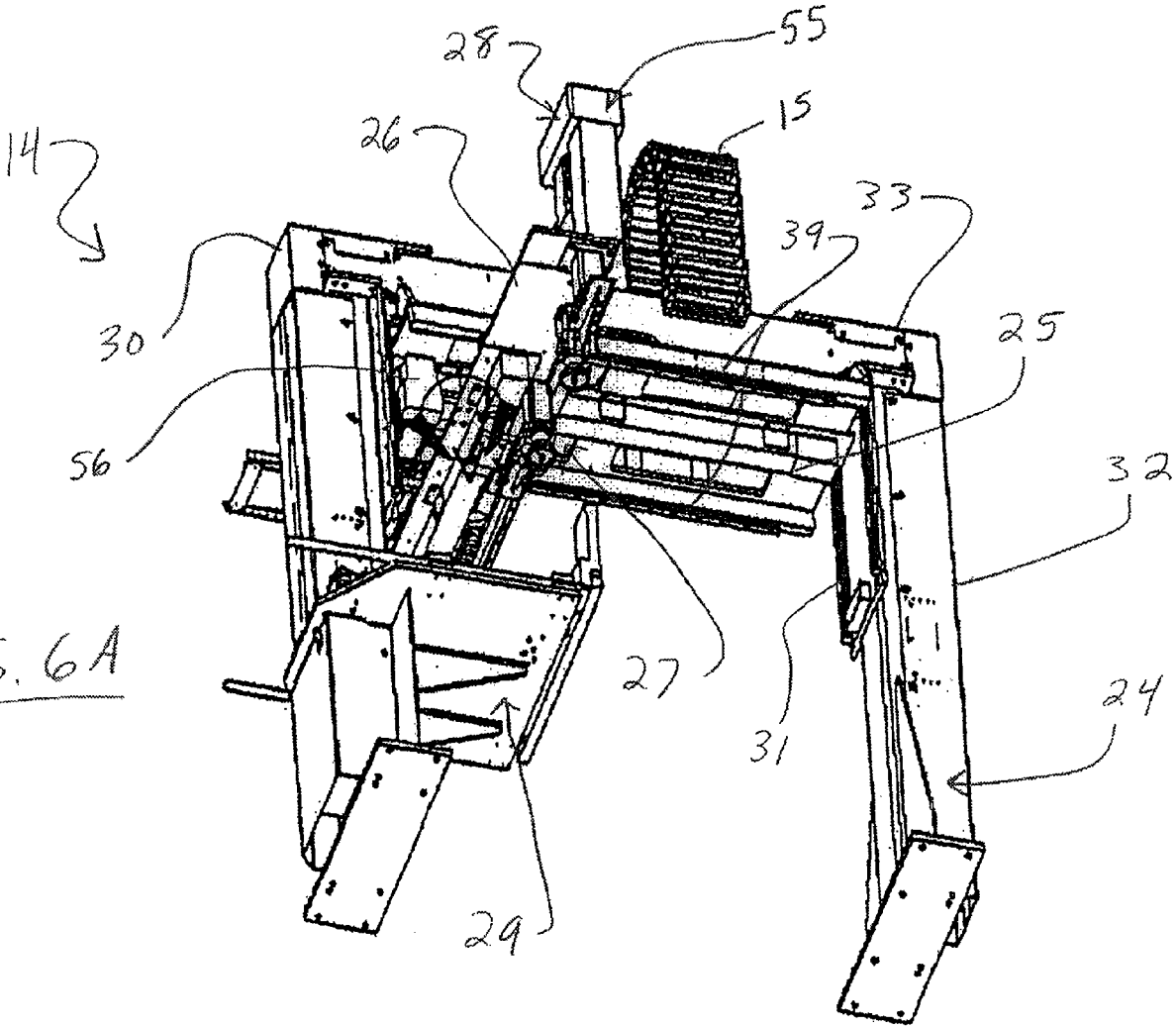
FIG. 6A is a bottom perspective view of the first cutting assembly of FIG. 5.

The first cutting assembly 14 is shown in FIGS. 1-4, and is illustrated in greater detail in FIGS. 5-6A. Separate components of the first cutting assembly 14 are illustrated in FIGS. 7-22. The first cutting assembly 14 is configured to cut through two sides of the container 11 in a lateral direction, i.e., across the width of the container 11. The major components of the first cutting assembly 14 are a carriage support 24, a vertical carriage 25, a lateral carriage 26, a blade assembly 27, a power system 28, and an indexing assembly 29.

Figure 7:
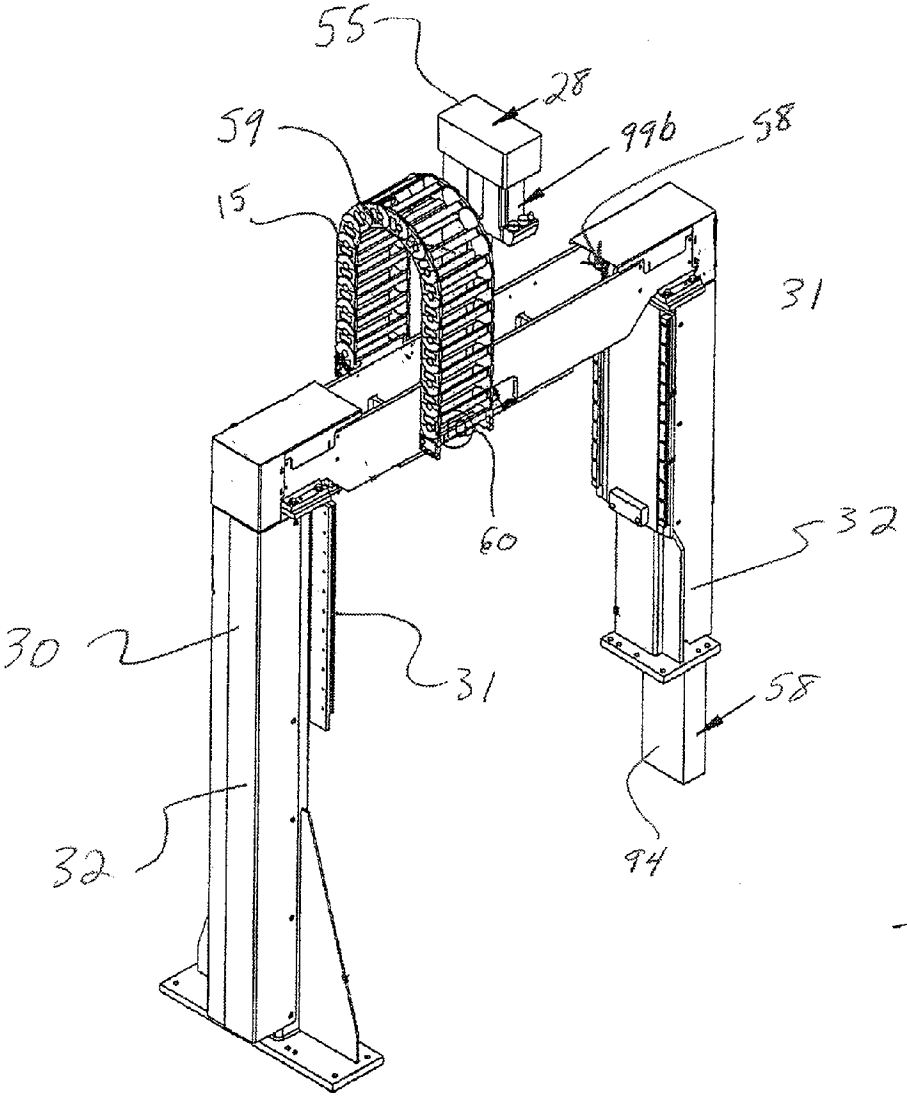
FIG. 7 is a perspective view of a carriage support for the first cutting assembly of FIG. 5.

The carriage support 24 for the first cutting assembly 14 is illustrated in FIGS. 5-7, and functions to support the other components of the first cutting assembly 14. The preferred carriage support 24 includes a support frame 30 and vertical linear bearing rails 31. The support frame 30 preferably straddles the conveyor 12 and is connected to, and supported by, the base frame 17. As shown, the support frame 30 includes two vertical support members 32 and a horizontal support member 33, with a plurality of connection points for connecting other components of the first cutting assembly 14. Two sets of vertical linear bearing rails 31 are located on each side of the carriage support 24. The vertical linear bearing rails 31 support the vertical carriage 25 and allow the vertical carriage 25 to slide vertically to adjust the cutting height of the first cutting assembly 14.

Figure 9:
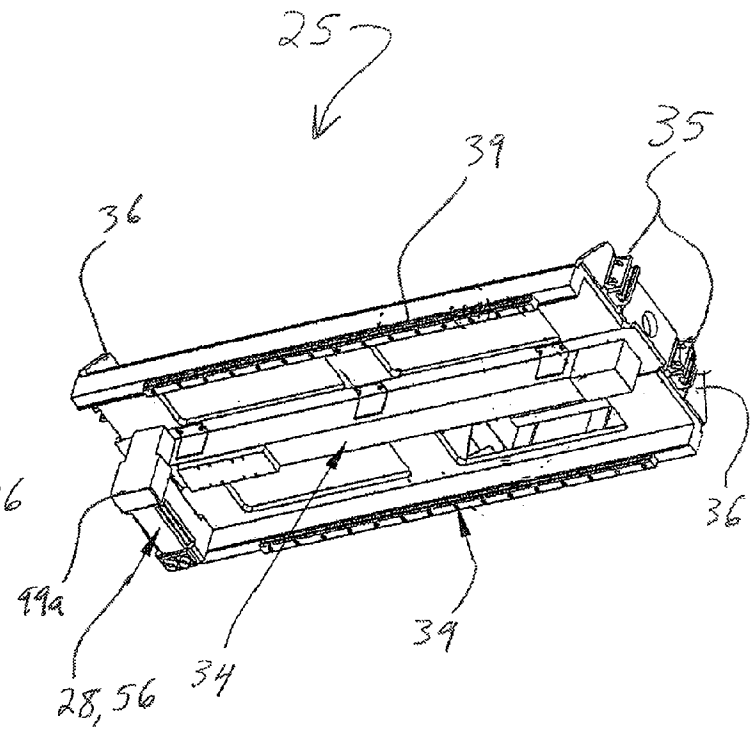
FIG. 9 is a bottom perspective view of the carriage of FIG. 8.
Figure 8:
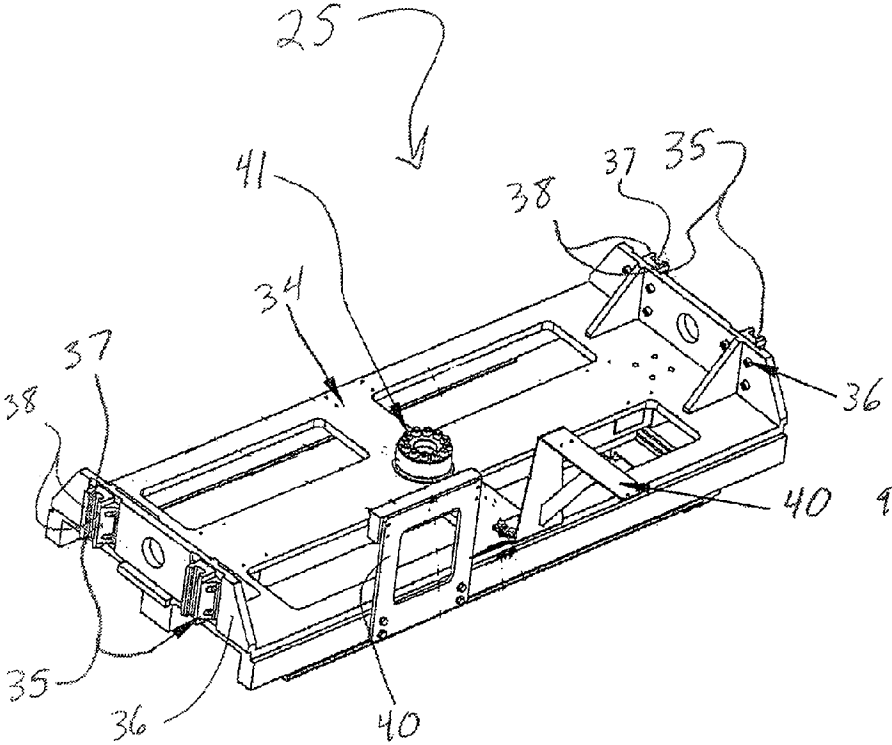
FIG. 8 is a perspective view of a carriage of the first cutting assembly of FIG. 5, designed for vertical movement.

The preferred vertical carriage 25 of the first cutting assembly 14 is shown in FIGS. 5-6A, and illustrated in more detail in FIGS. 8-9. The vertical carriage 25 includes a carriage frame 34 having two sets of sliding supports 35 fixed to support plates 36 at opposing ends. The sliding supports 35 have vertical channels 37 with inward-facing flanges 38 that form a clamping arrangement. This clamping arrangement allows the sliding supports 35 to slidably grip onto the vertical linear bearing rails 31 of the carriage support 24, enabling the vertical carriage 25 to slide vertically along the bearing rails 31 to adjust the cutting height of the first cutting assembly 14. The vertical carriage 25 also includes a pair of lateral linear bearing rails 39 located on each side of the carriage frame 34. These lateral linear bearing rails 39 support the lateral carriage 26 and allow the lateral carriage 26 to slide laterally during the cutting action of the first cutting assembly 14. Wiring supports 40 are preferably affixed to the vertical carriage 25 to support the wiring connecting the various components of the first cutting assembly 14. A retaining coupling 41 in the center of the carriage frame 34 provides a connection point for the power system 28 to raise and lower the vertical carriage 25. The vertical carriage 25 also supports a servo motor 99*a* for the power system 28 and connection points for other components of the case cutter 10, discussed below.

Figure 10:
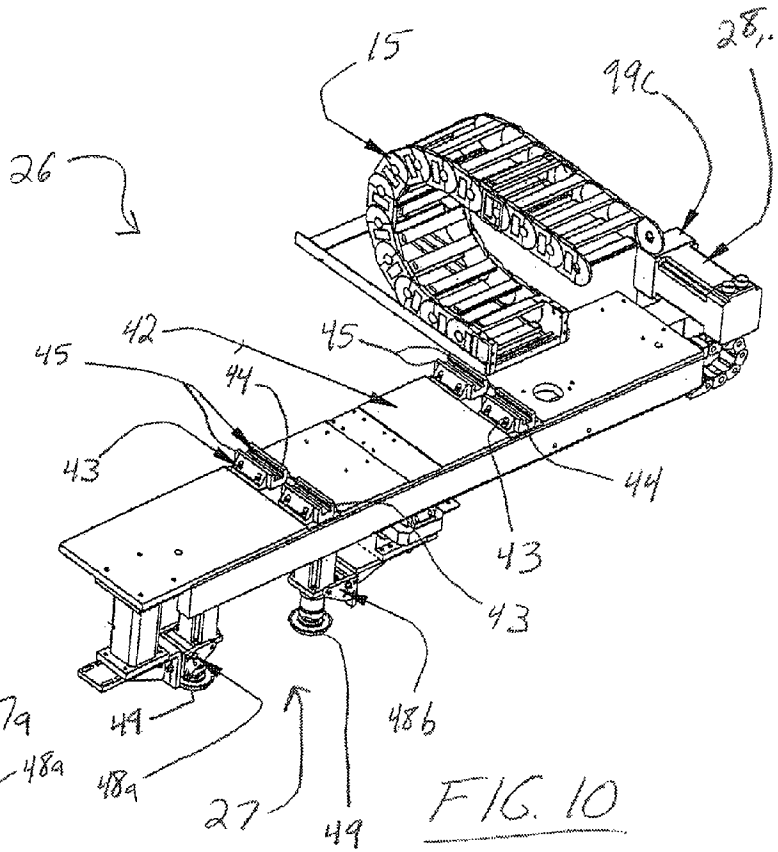
FIG. 10 is a perspective view of a carriage and blade assembly of the first cutting assembly of FIG. 5, designed for lateral movement.
Figure 11:
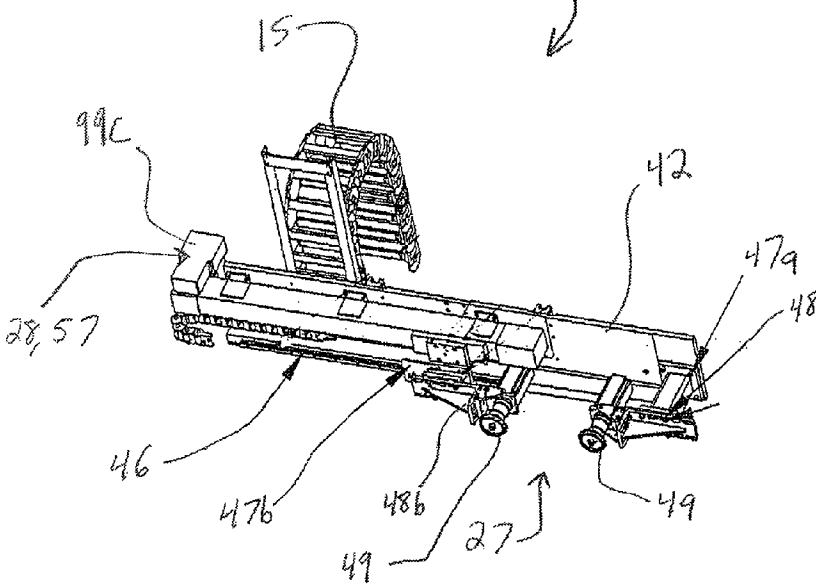
FIG. 11 is a bottom perspective view of the carriage and blade assembly of FIG. 10.

The preferred lateral carriage 26 of the first cutting assembly 14 is shown in FIGS. 5-6A, and illustrated in more detail in FIGS. 10-11. The lateral carriage 26 includes a carriage frame 42 having a set of sliding supports 43 fixed to the top surface. These sliding supports 43 are similar in structure and function to the sliding supports 35 of the vertical carriage 25, and have lateral channels 44 with inward-facing flanges 45 that form a clamping arrangement. The clamping arrangement allows the sliding supports 43 to slidably grip onto the lateral linear bearing rails 39 on the vertical carriage 25, enabling the lateral carriage 26 to slide laterally along the bearing rails 39 to perform the cutting operation. The lateral carriage 26 also supports the blade assembly 27 for the first cutting assembly 14, and includes a longitudinal linear bearing rail 46 and cutter mounts 47*a*, 47*b* located on the underside for this purpose. The bearing rail 46 slidably supports one cutter head 48*b* of the blade assembly 27 and enables one of the blades 49 to slide longitudinally to adjust the blade spacing relative to the measured length of the container 11. The lateral carriage 26 also supports a servo motor 99*c* for the power system 28 and connection points for other components of the case cutter 10, discussed below.

Figure 12:
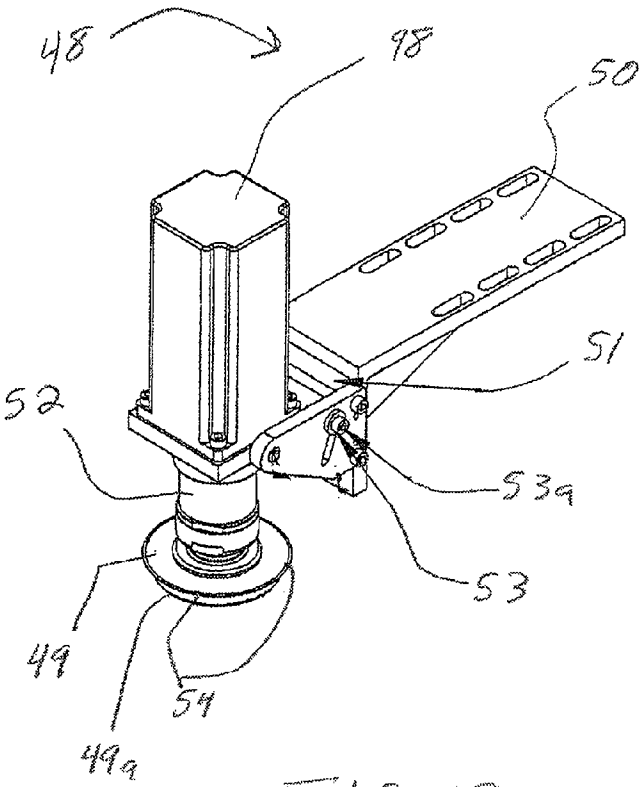
FIG. 12 is a perspective view of a cutter head for the blade assembly of FIG. 10.
Figure 13:
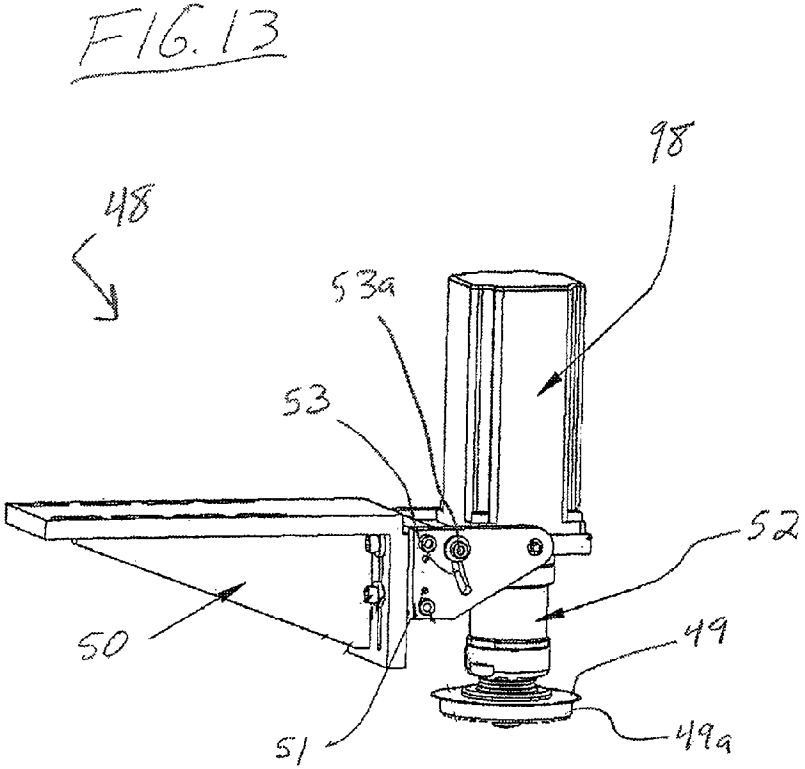
FIG. 13 is a side view of the cutter head of FIG. 12.

The blade assembly 27 of the first cutting assembly 14 is illustrated in FIGS. 5-6A and 10-11, and preferably includes two cutter heads 48, illustrated in FIGS. 12-13. One of the cutter heads 48*a* is fixed, and the other cutter head 48*b* is moveable to adjust the cutting length to the length of the container 11 measured by the measuring device 13. The fixed cutter head 48*a* is affixed to the underside of the lateral carriage 26 by a cutter mount 47*a*, as described above. The moveable cutter head 48*b* is mounted on the longitudinal linear bearing rail 46 of the lateral carriage 26 by another cutter mount 47*b*, as described above. The moveable cutter head 48*b* can slide longitudinally along the bearing rail 46 to adjust the blade spacing relative to the measured length of the container 11. A servo motor 99*c* mounted on the lateral carriage 26 is operably connected to the moveable cutter head 48 to power this movement, as described below.

Figure 3:
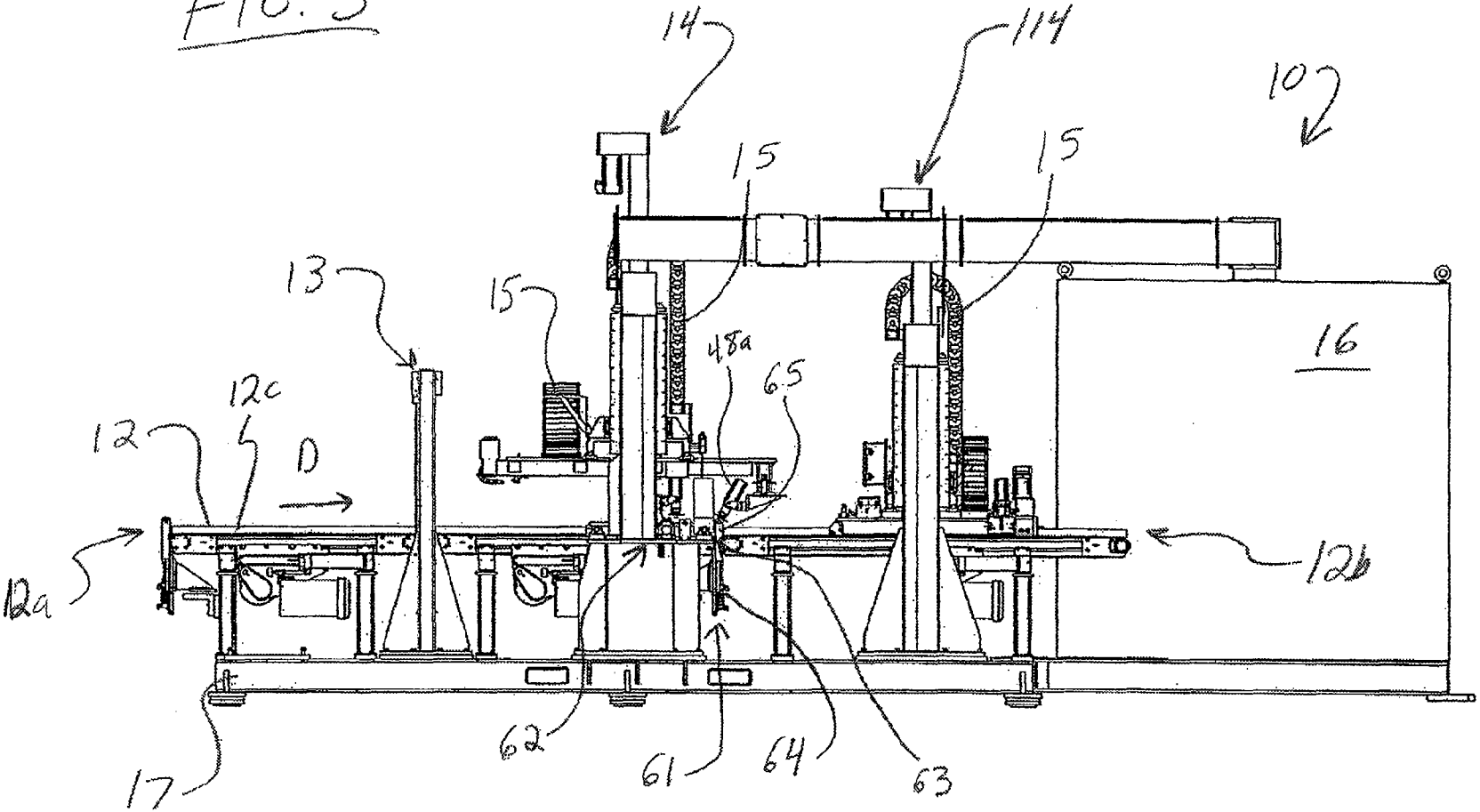
FIG. 3 is a side view of the case cutter apparatus of FIG. 1.
Figure 4:
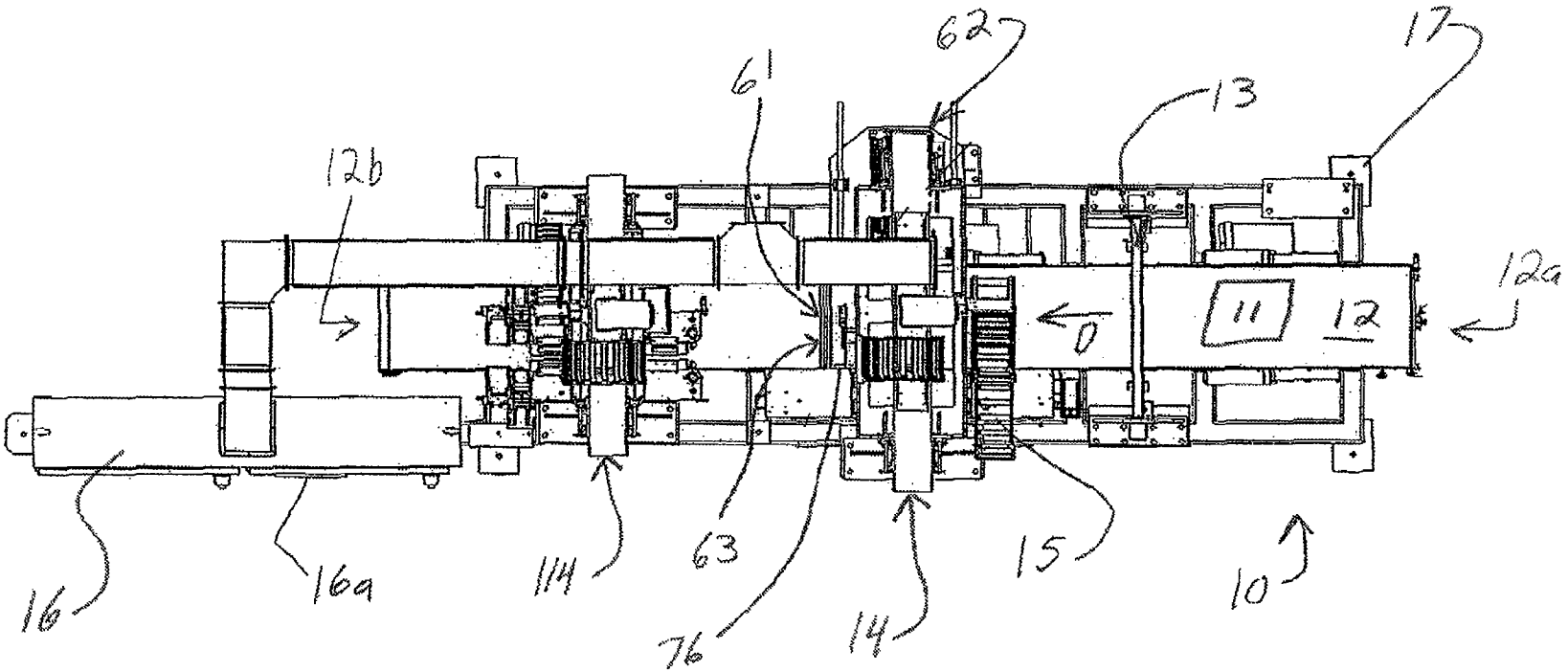
FIG. 4 is a plan view of the case cutter apparatus of FIG. 1.
Figure 24:
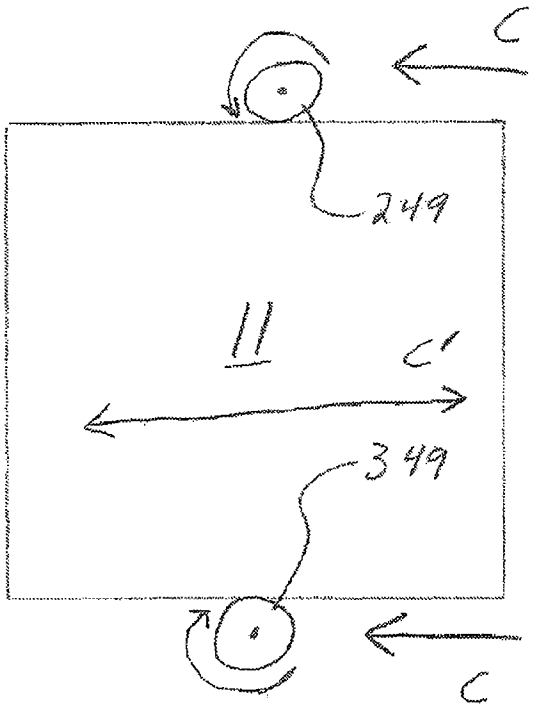
FIG. 24 is a schematic view of a blade assembly of the present invention cutting a container, wherein the blade assembly is moving right to left.
Figure 23:
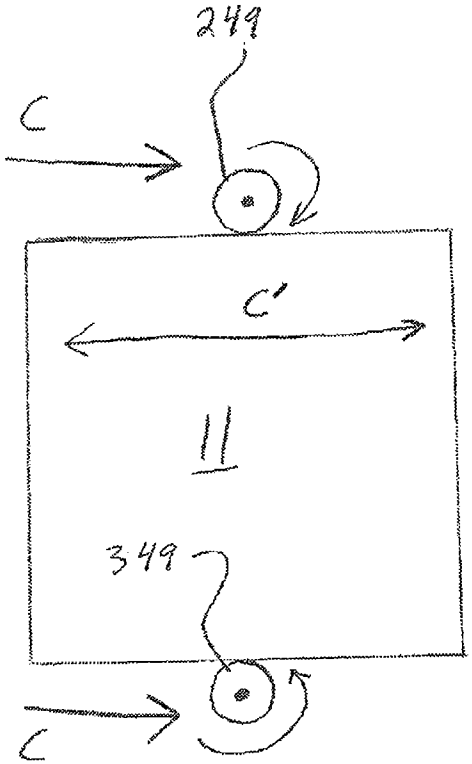
FIG. 23 is a schematic view of a blade assembly of the present invention cutting a container, wherein the blade assembly is moving left to right.

Each cutter head 48 includes a servo motor 98, a mounting plate 50, a pivoting mechanism 51, a connecting assembly 52, and a blade 49. The mounting plate 50 is configured to be mounted on one of the cutter mounts 47*a*, 47*b* of the lateral carriage 26 and to support the other components of the cutter head 48. The servo motor 98 provides power to the connecting assembly 52 to rotate the connecting assembly 52 and the blade 49 for the cutting operation. The servo motor 98 is mounted on the pivoting mechanism 51, which is mounted on the mounting plate 50. The pivoting mechanism 51 allows the servo motor 98, along with the blade 49 and connecting assembly 52, to pivot, adjusting the cutting angle of the blade. FIG. 3 illustrates a cutter head 48*a* that is pivoted to adjust the cutting angle. In the preferred embodiment, the pivoting mechanism 51 includes two slots 53 and two manually-adjustable pins 53*a* which slide in the slots 53 to allow freedom of movement. Alternately, the pivoting mechanism 51 could include an automated pivoting mechanism controllable by the controller to automatically adjust the cutting angle of the blade 49. For example, an additional servo motor (not shown) could be used to provide this movement to the blade 49. The connecting assembly 52 preferably is a multi-piece assembly and includes a quick-connect/disconnect assembly 89, illustrated in FIGS. 14-18, 36-38B, and 54-55, which is discussed in greater detail below. The blade 49 of the first cutting assembly 14 is preferably a disk with a sharp circular outer edge 49*b* and has four notches 54 positioned at regular intervals around the edge of the blade 49. In the embodiment shown in FIGS. 15-17, the notches 54 are positioned at 90° intervals. These notches 54 decrease blade wear and increase blade life. The blade 49 also preferably includes a circular guide washer 49*a* positioned at the bottom of the blade 49. The guide washer 49*a* abuts the wall of the container during cutting, limiting the depth that the blade 49 can cut and thus preventing the blade 49 from cutting too deeply into the container 11 and damaging the contents inside. The cutter heads 48 operate so that the blades 49 can spin in either direction during cutting. Preferably, the blades spin so that the portion of the blade 49 that is in contact with the container 11 is moving the opposite direction as the lateral carriage, as illustrated in FIGS. 23-24. This aspect is discussed in greater detail below.

The preferred power system 28 is shown in FIGS. 5-11 and 40. The power system 28 includes a vertical drive 55, a lateral drive 56, a longitudinal drive 57 and a counterweight assembly 58, and is used to move the vertical carriage 25, the lateral carriage 26, and the blade assembly 27 during the cutting operation. The vertical drive 55 (FIGS. 5-7) preferably includes a servo motor 99*b*, a connecting rod 59, and a coupler 60 at the tip of the connecting rod 59 for operably connecting to the retaining coupling 41 of the vertical carriage 25. The servo motor 99*b* is preferably mounted on the carriage support 24 and operates to extend and retract the connecting rod 59 to raise and lower the vertical carriage 25. The lateral drive 56 is operably connected to the lateral carriage 26 and contains a servo motor 99*a* mounted on the vertical carriage 25 (FIG. 9) for moving the lateral carriage 26 laterally during the cutting operation. The longitudinal drive 57 is operably connected to one of the cutter heads 48 of the blade assembly 27 and contains a servo motor 99*c* mounted on the lateral carriage 26 for moving the moveable cutter head 48 to adjust the cutting length of the blade assembly 27. The counterweight assembly 58 functions to minimize the force necessary to raise and lower the vertical carriage 25, and is discussed in greater detail below.

The preferred indexing assembly 29 is shown generally in FIGS. 1-6A and illustrated in more detail in FIGS. 19-22. The indexing assembly 29 is generally made up of a stop mechanism 61 and a bracing mechanism 62. The stop mechanism 61 is preferably positioned below the conveyor 12 and can be raised up through a gap 63 in the conveyor 12 to stop the forward motion of a container 11 thereon to allow for cutting. After cutting, the stop mechanism 61 can then be lowered to allow the container 11 to move farther down the conveyor 12. The bracing mechanism 62 is preferably positioned alongside the conveyor 12 and can be pushed outwardly to squeeze the container 11 and prevent lateral movement during cutting. After cutting, the bracing mechanism 62 can be released to allow the container 11 to move again.

Figure 21:
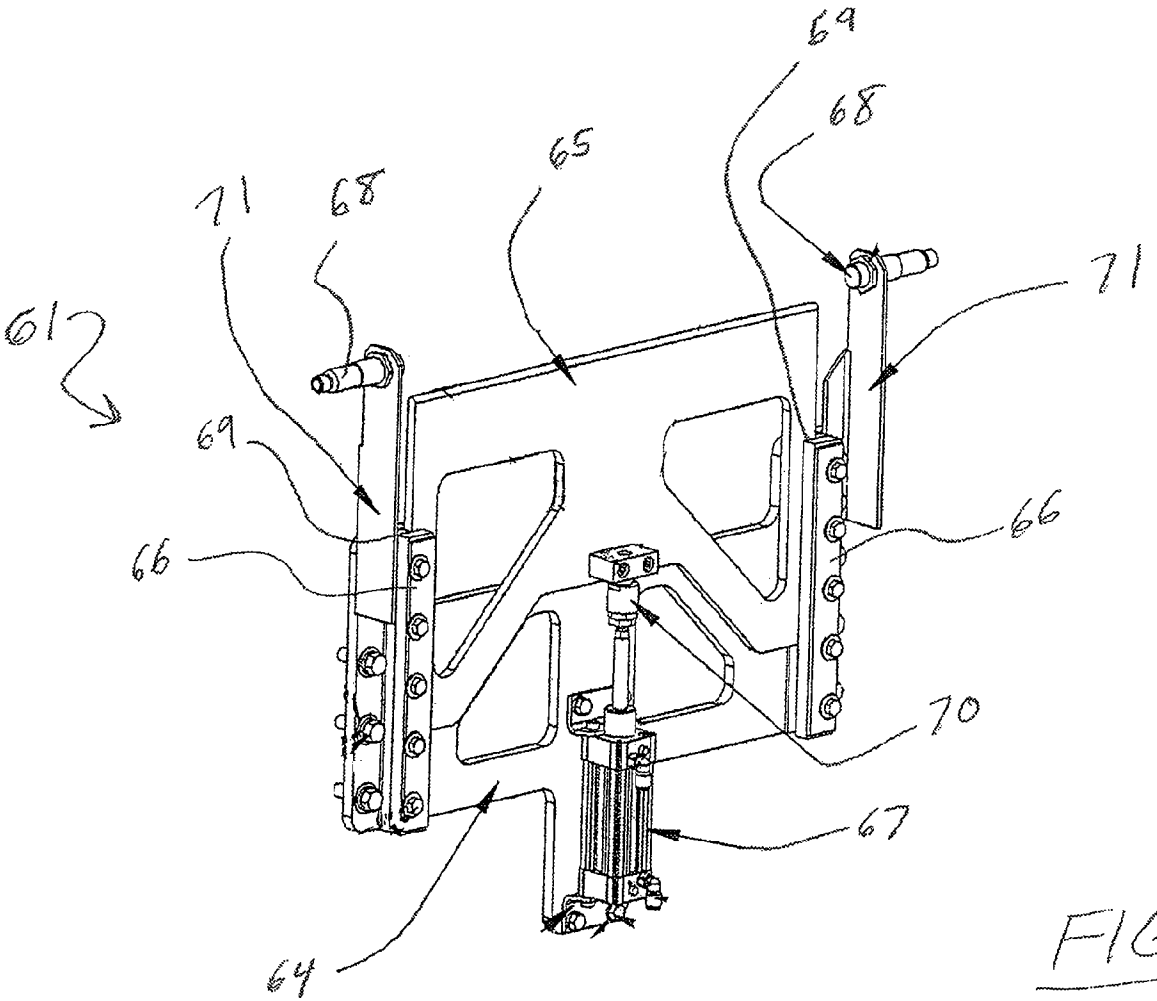
FIG. 21 is a perspective view of a stop for an indexing assembly of the case cutter apparatus of FIG. 1.
Figure 22:
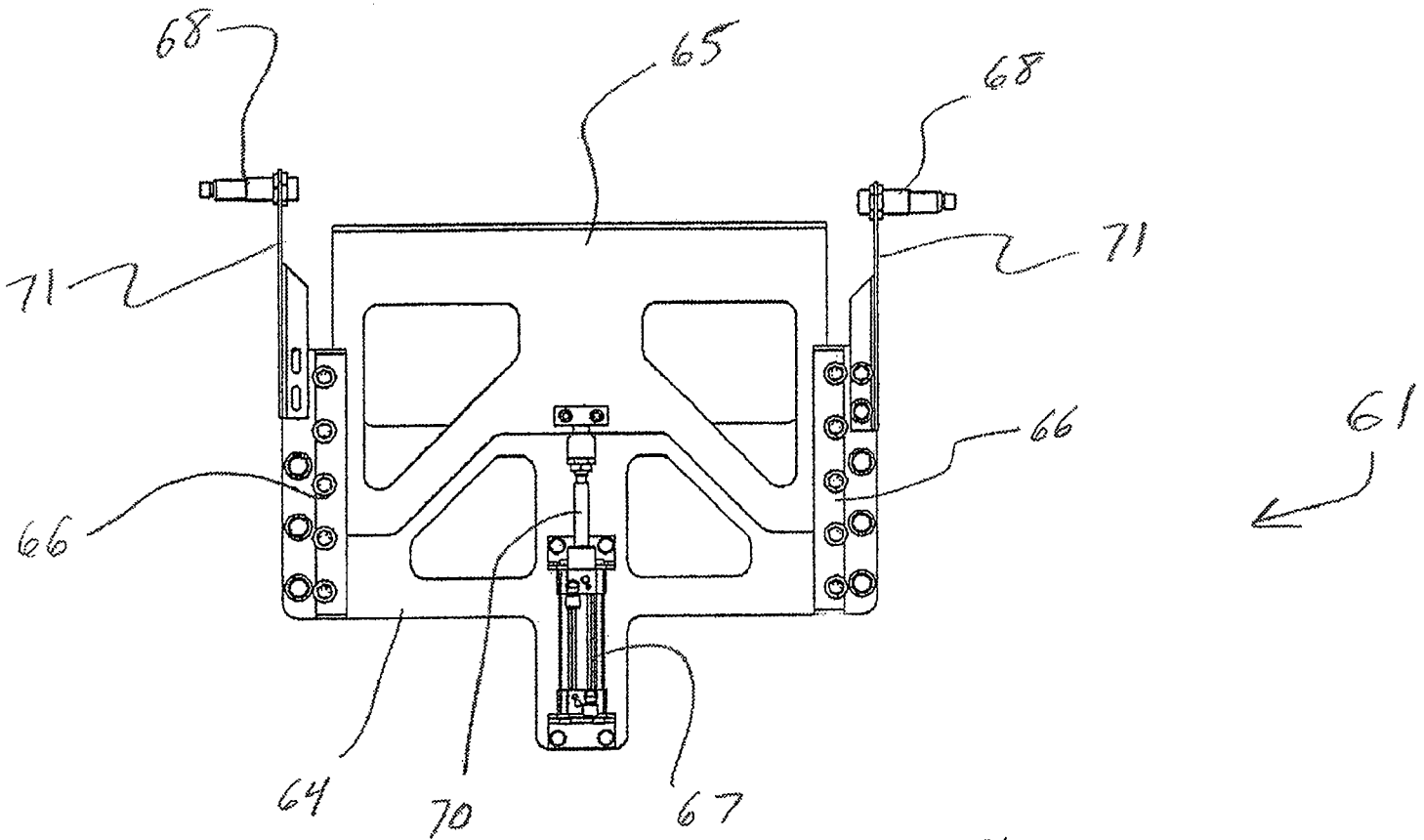
FIG. 22 is a front view of the stop of FIG. 21.

The stop mechanism 61 is illustrated in FIGS. 21-22, and includes a mounting structure 64, a moveable plate 65 slidably positioned between two guides 66, an actuator 67, and proximity sensors 68. The mounting structure 64 supports the other components of the stop mechanism 61 and is affixed to the case cutter apparatus 10 within a gap 63 in the conveyor 12. The guides 66 are mounted on the sides of the mounting structure 64, and each have a vertical slot 69 facing inward. The moveable plate 65 is held by the guides 66 such that two opposing edges of the plate 65 are each received in one of the slots 69. In this arrangement, the plate 65 can slide vertically within the guides 66. The actuator 67 functions to raise and lower the plate 65 to operate the stop mechanism 61. Preferably, the actuator 67 is an air cylinder mounted on the mount structure 64 having an extending rod 70 coupled to the moving plate 65. The air cylinder 67 extends and retracts the rod 70 to raise and lower the plate 65. When the plate 65 is raised or extended, it blocks the conveyor 12 and stops the movement of the container 11 when the container 11 moves to abut the plate 65. Lowering or retracting the plate 65 permits the container 11 to move once again down the conveyor 12. In other words, the actuator 67 moves the plate 65 between a first (extended) position, wherein the plate 65 extends through the gap 63 in the conveyor 12 and above the top surface 12*c* of the conveyor 12 to abut the front of the container 11, and a second (retracted) position, where the plate 65 is retracted and does not extend above the top surface 12*c* of the conveyor 12 or abut the container 11. The proximity sensors 68 are mounted on two arms 71 that extend upwardly from the guides 66 and through the gap 63 in the conveyor 12, and are, thus, positioned on opposing sides of the conveyor 12.

The proximity sensors 68 detect whether a container 11 is proximate the plate 65 and relays the information to the controller 16 to determine when the container 11 is stopped by the stop mechanism 61 and ready for further indexing. The proximity sensors 68 can also detect whether a container 11 is positioned directly over the stop mechanism 61 to prevent raising of the plate 65 when a container 11 is obstructing such movement. The proximity sensors 68 are preferably inductive sensors, but may alternately be a different type of sensor, such as laser sensors or sonic sensors.

Figure 19:
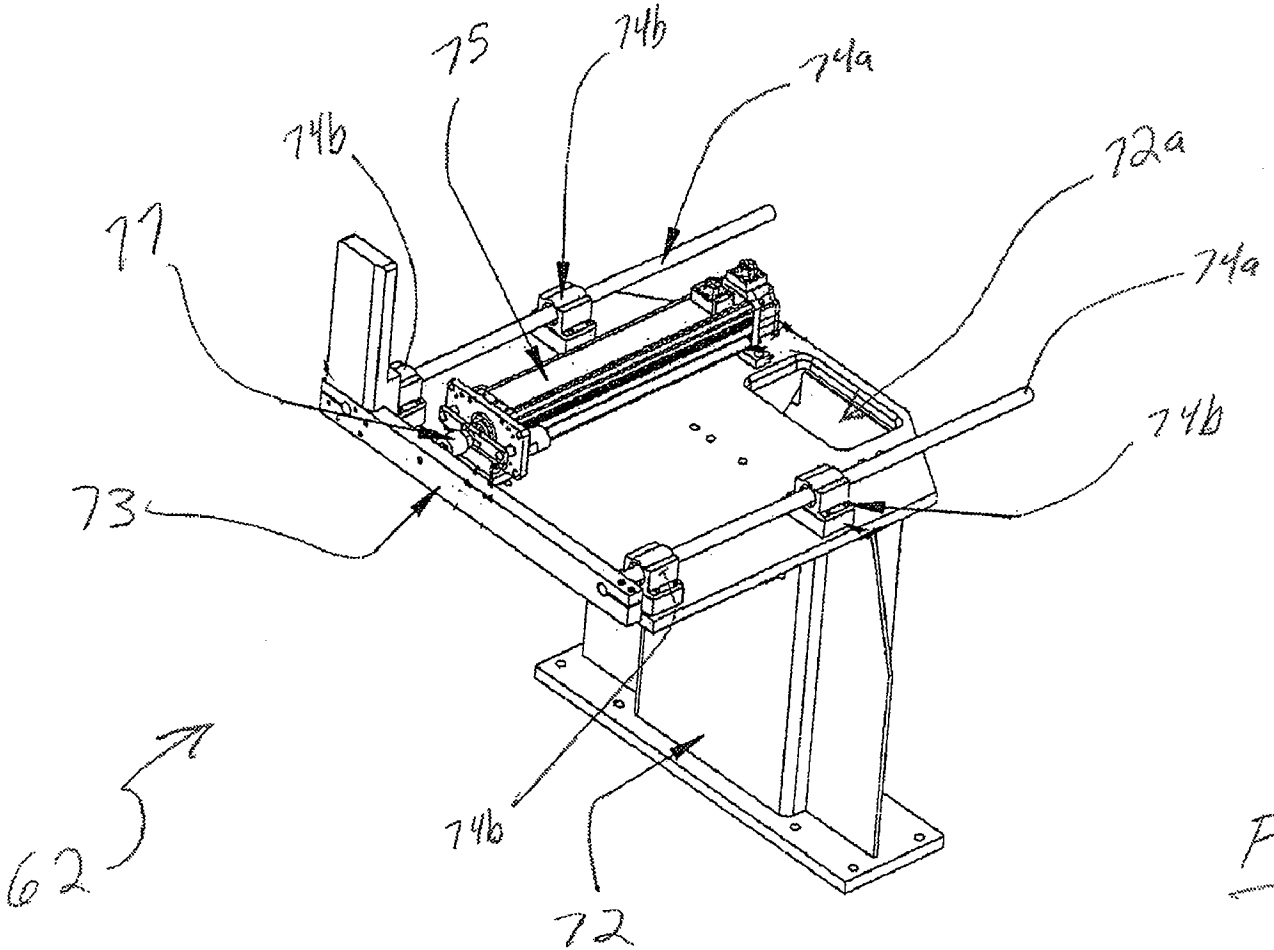
FIG. 19 is a perspective view of a portion of an indexing assembly of the case cutter apparatus of FIG. 1.
Figure 20:
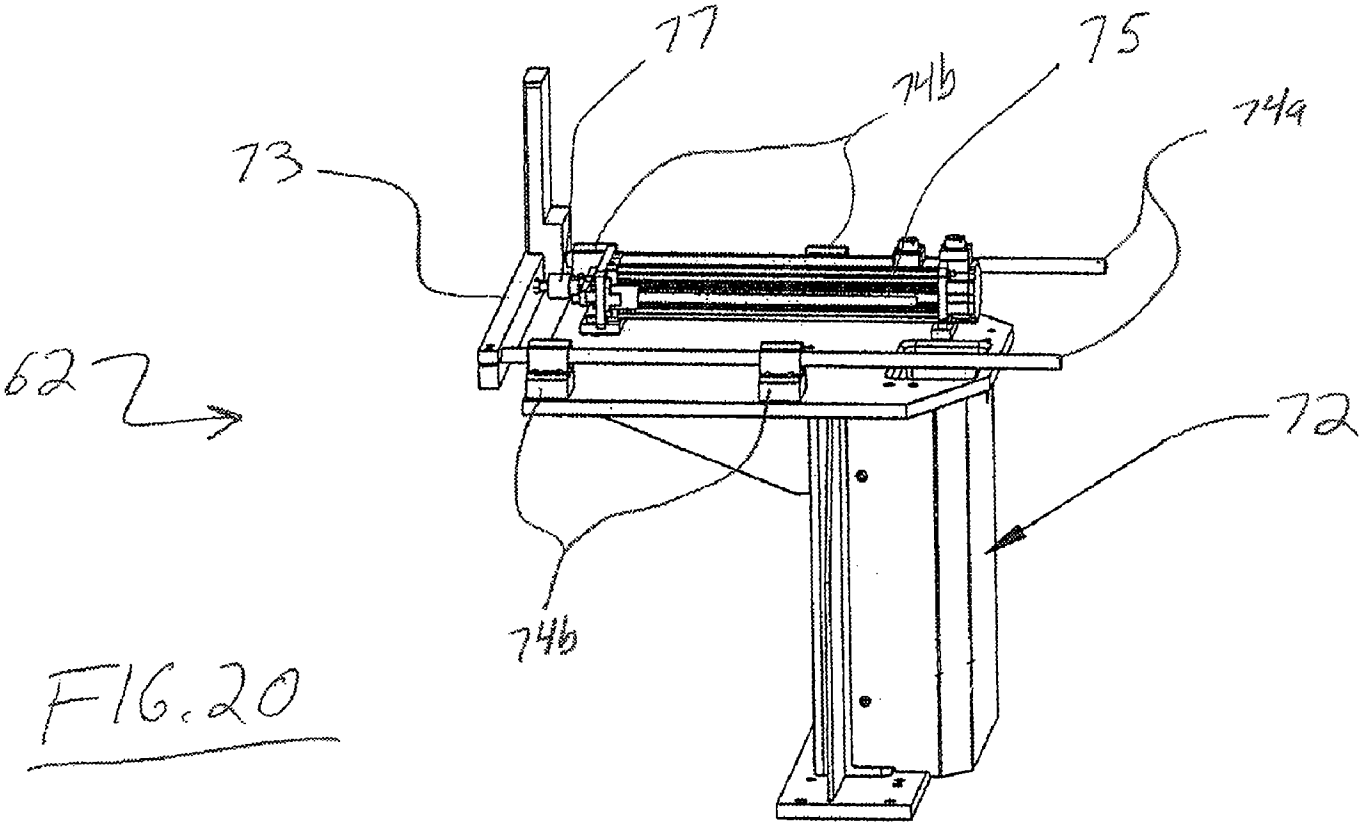
FIG. 20 is a front view of the portion of the indexing assembly of FIG. 19.

The bracing mechanism 62 is illustrated in FIGS. 19-20, and includes a support structure 72, a moveable bar 73 slidably mounted on two guide shafts 74*a* held by bearing blocks 74*b*, an actuator 75, and a bracing wall 76 (FIG. 1). One of the vertical support members 32 of the carriage support 24 is affixed to the top surface of the support structure 72, and the bottom of the support structure 72 is affixed to the base frame 17. As such, the support structure 72 supports both the carriage support 24 and the components of the bracing mechanism 62. The support structure 72 also has a passage 72*a* therethrough to permit a weight 94 of the counterweight assembly 58 to extend therethrough. Alternately, the carriage support 24 may be directly connected to the base frame 17, and the support structure 72 may be mounted to the carriage support 24 or mounted elsewhere on the base frame 17. Two pairs of bearing blocks 74*b* are affixed to the top surface of the support structure 72, each pair holding one of the two guide shafts 74*a* in a sliding arrangement. Each guide shaft 74*a* is affixed at one end to the moveable bar 73, and allow the bar 73 to slide linearly back and forth. The body of the support structure 72 extends to an edge of the conveyor 12 so that the bar 73 is positioned immediately adjacent the conveyor 12. The bracing wall 76 is positioned adjacent the moving bar 73, on the opposite edge of the conveyor 12. Preferably, the actuator 75 is an air cylinder affixed to the support structure 72 and having an extending rod 77 coupled to the moving bar 73. The air cylinder 75 extends the rod 77 to push the bar 73 laterally out onto the surface of the conveyor 12, and retracts the rod to pull the bar 73 back into position adjacent the conveyor 12. Extending the bar 73 laterally pushes a container 11 located on the conveyor 12 into contact with the bracing wall 76 opposite the bar 73, squeezing the container 11 between the bar 73 and the bracing wall 76. Thus, the container 11 is laterally braced on both sides by the bar 73 and the bracing wall 76. In other words, the actuator 75 moves the bar 73 between a first (extended) position, where the bar 73 abuts the container 11 and squeezes the container 11 between the bar 73 and the bracing wall 76 to prevent lateral movement of the container 11 during cutting, and a second (retracted) position, where the bar 73 is retracted and does not abut the container 11. When the stop mechanism 61 is also engaged, the container 11 is prevented from movement in three directions, which indexes the container (i.e. holds the container in place) to prevent shifting during the cutting operation.

Figure 25:
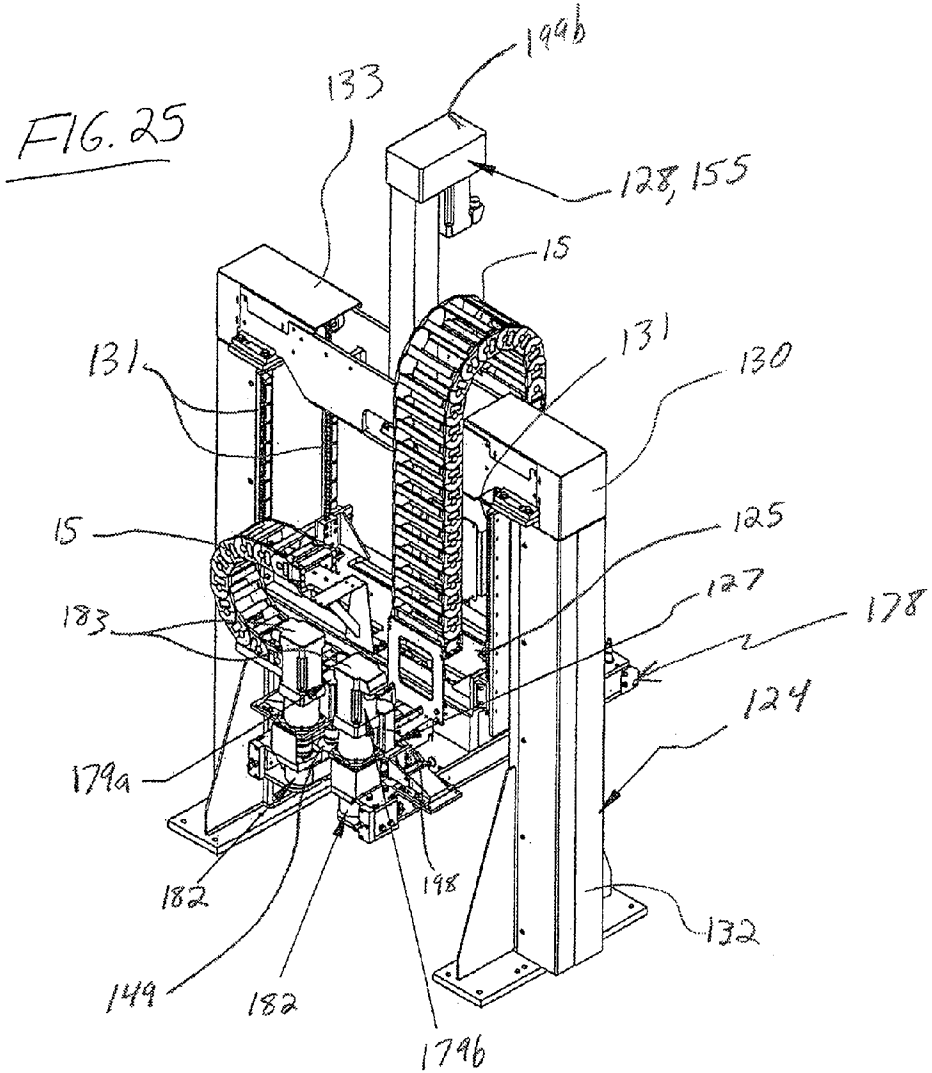
FIG. 25 is a rear perspective view of a second cutting assembly of the case cutter apparatus of FIG. 1.
Figure 27:
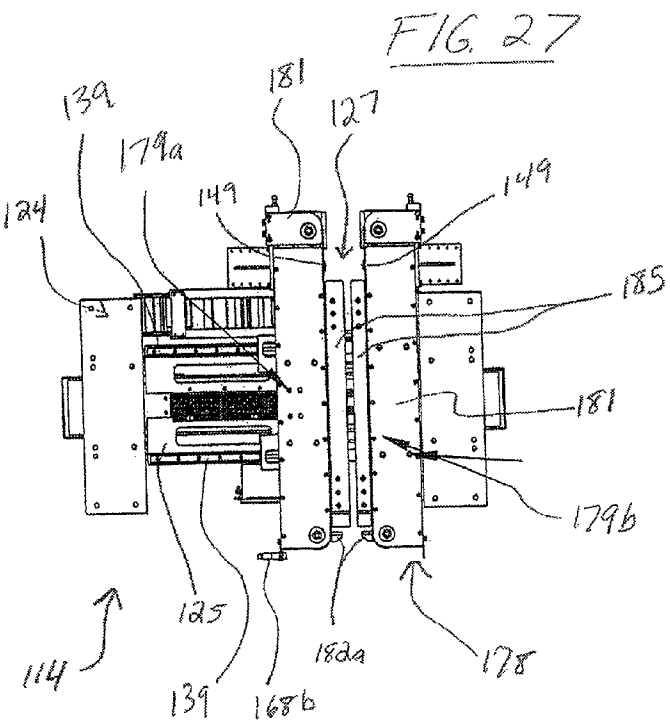
FIG. 27 is a bottom view of the second cutting assembly of FIG. 25.
Figure 26:
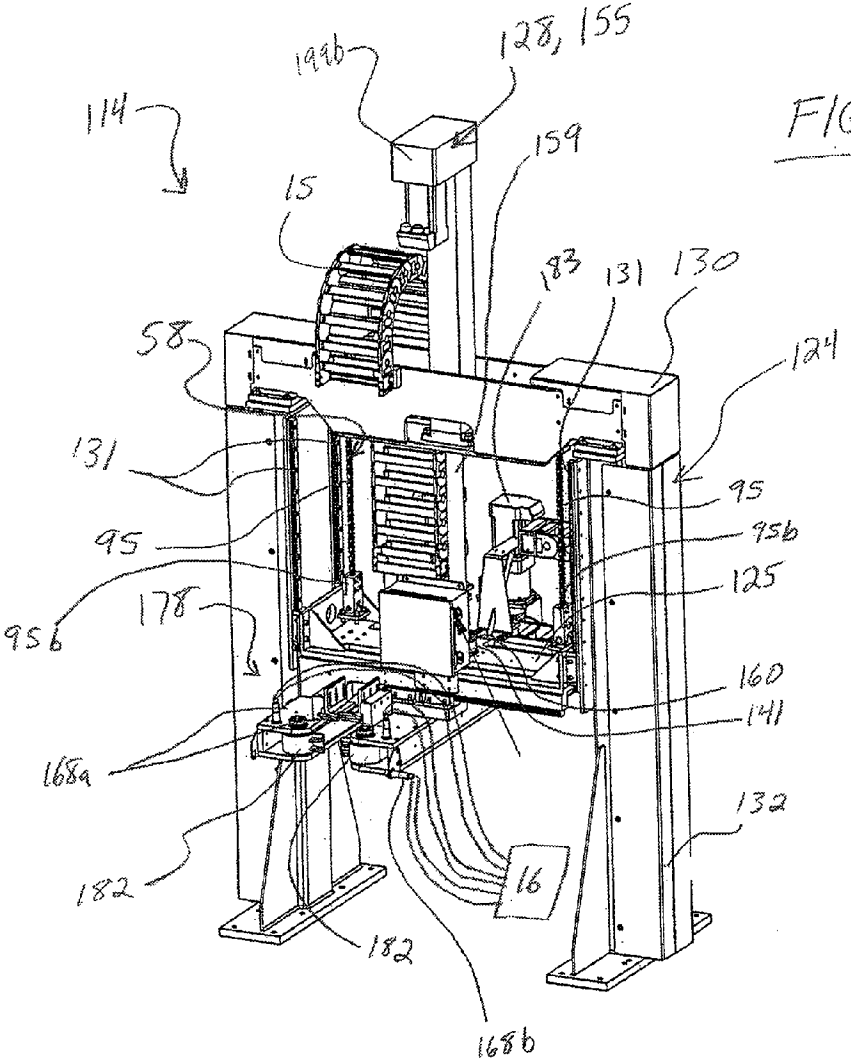
FIG. 26 is a front perspective view of the second cutting assembly of FIG. 25.
Figure 28:
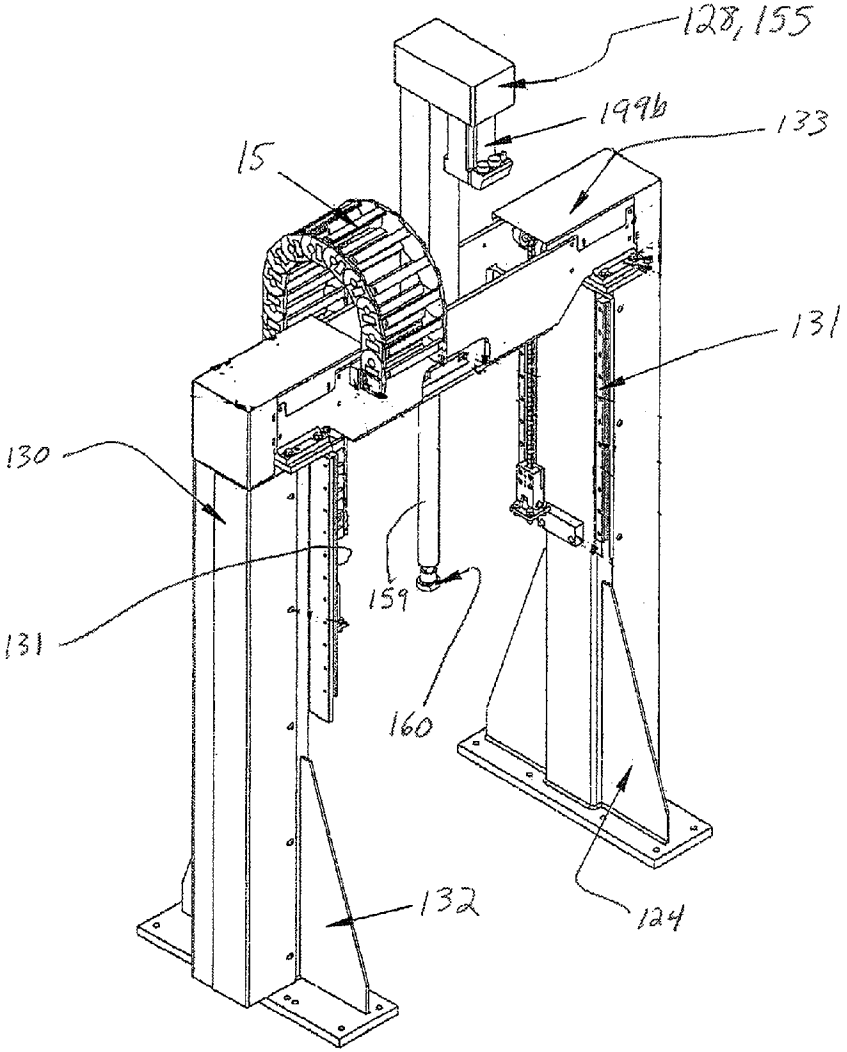
FIG. 28 is a perspective view of a carriage support for the second cutting assembly of FIG. 25.

The second cutting assembly 114 is shown in FIGS. 1-4, and is illustrated in greater detail in FIGS. 25-27. Separate components of the second cutting assembly 114 are illustrated in FIGS. 28-35. The second cutting assembly 114 is configured to cut through two sides of the container 11 in a longitudinal direction, i.e., down the length of the container 11. The major components of the second cutting assembly 114 are a carriage support 124, a vertical carriage 125, a belt drive system 178, a blade assembly 127, and a power system 128.

The carriage support 124 for the second cutting assembly is illustrated in FIGS. 25-28, and functions to support the other components of the second cutting assembly 114. The preferred carriage support 124 includes a support frame 130 and vertical linear bearing rails 131. The support frame 130 preferably straddles the conveyor 12 and is connected to, and supported by, the base frame 17. As shown, the support frame 130 includes two vertical support members 132 and a horizontal support member 133, with a plurality of connection points for connecting other components of the second cutting assembly 114. Two sets of vertical linear bearing rails 131 are located on each side of the carriage support 124. The vertical linear bearing rails 131 support the vertical carriage 125 and allow the vertical carriage 125 to slide vertically to adjust the cutting height of the second cutting assembly 114.

Figure 30:
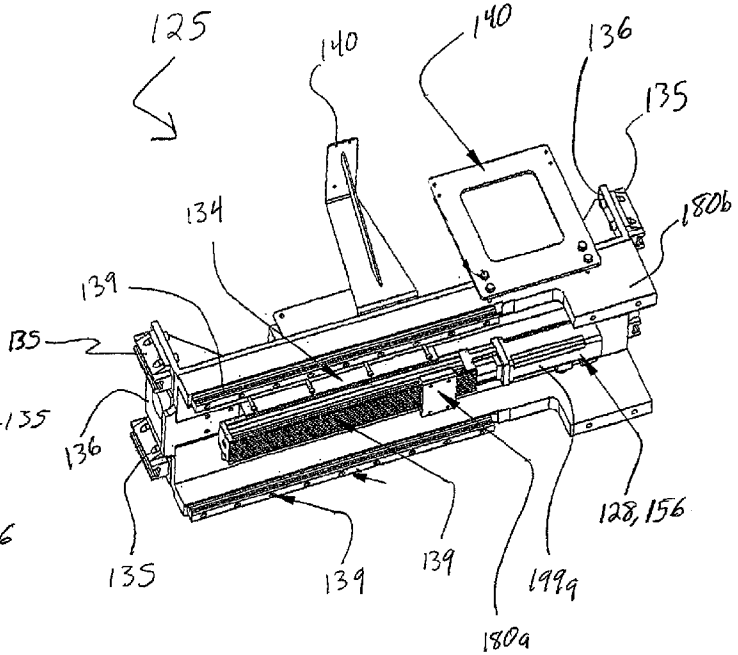
FIG. 30 is a bottom perspective view of the carriage of FIG. 29.
Figure 29:
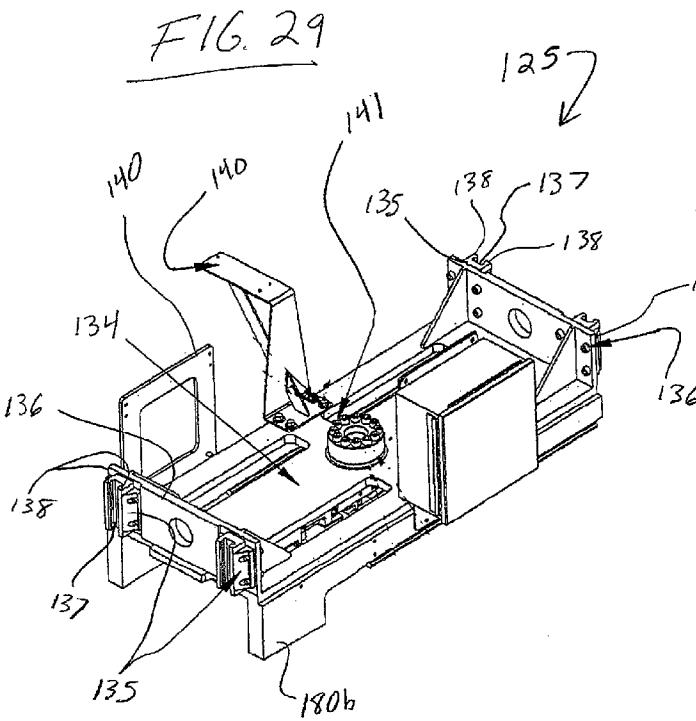
FIG. 29 is a perspective view of a carriage of the second cutting assembly of FIG. 25, designed for vertical movement.

The preferred vertical carriage 125 of the second cutting assembly 114 is shown in FIGS. 25-27, and illustrated in more detail in FIGS. 29-30. The vertical carriage 125 of the second cutting assembly 114 is similar in structure and function to the vertical carriage 25 of the first cutting assembly 14 and includes a carriage frame 134 having two sets of sliding supports 135 fixed to support plates 136 at opposing ends. The sliding supports 135 have vertical channels 137 with inward-facing flanges 138 that form a clamping arrangement. This clamping arrangement allows the sliding supports 135 to slidably grip onto the vertical linear bearing rails 131 of the carriage support 124, enabling the vertical carriage 125 to slide vertically along the bearing rails 131 to adjust the cutting height of the second cutting assembly 114. The vertical carriage 125 also includes three lateral linear bearing rails 139 located on each side of the carriage frame 134. These lateral linear bearing rails 139 support a moveable belt assembly 179*a* of the belt drive system 178 and allow the belt assembly 179*a* to slide laterally to adjust the cutting width of the second cutting assembly 114. A moveable belt mount 180*a* is coupled to the middle lateral bearing rail 139 for mounting a moveable belt assembly 179*a* of the belt drive system 178. A fixed belt mount 180*b* is located on the vertical carriage 125 for mounting a fixed belt assembly 179*b* of the belt drive system 178. Wiring supports 140 are preferably affixed to the vertical carriage 125 to support the wiring connecting the various components of the second cutting assembly 114. A retaining coupling 141 in the center of the carriage frame 134 provides a connection point for the power system 128 to raise and lower the vertical carriage 125. The vertical carriage 125 also supports a servo motor 199*a* for the power system 128 and connection points for other components of the case cutter 10, discussed below.

The belt drive system 178 is illustrated in FIGS. 25-27 and 31, and generally includes a moveable belt assembly 179*a* and a fixed belt assembly 179*b*. The belt assemblies 179 are similarly constructed and each include a housing 181, a belt 182, a belt drive motor 183, a roller 184, a ski 185, and at least one proximity sensor 168. The housing 181 of each belt assembly 179 has an interior channel 181*a* to contain, support, and protect the belt 182. The housing 181 also provides mounting surfaces for the other components of the belt drive system 178, including a motor mount 183*a* for the belt drive motor 183 and ski mounts 185*a* for the ski 185. The belt drive motor 183 is preferably an electric motor mounted securely on the housing 181 via the motor mount 183*a* and has a drive shaft 186 extending from the motor 183 and terminating in a powered sprocket 186*a*. The belt 182 is wrapped around the sprocket 186*a* and the non-powered roller 184 in tension so that activation of the belt drive motor 183 causes the belt 182 to continuously travel in a loop through the channel 181*a*. The belt 182 also has at least one, and preferably two cleats, lugs, or tangs 182*a* affixed to the outer surface. These cleats 182*a* engage the rear of the container 11 and operate with rotation of the belt 182 to push the container 11 through the second cutting assembly 114. The channel 181*a* is preferably dimensioned deeply enough that the cleat 182*a* can move through the channel 181*a* unimpeded. The ski 185 is fixedly mounted to the housing 181 via the ski mounts 185*a*, and operates to brace the container 11 during cutting and exert downward pressure on the container 11 top to prevent opening or bulging. Preferably, the ski 185 has an upturned end 185*b* to assure easy engagement with the container 11, and the ski 185 is smooth to assure easy sliding of the ski 185 along the top of the container 11.

Figure 31:
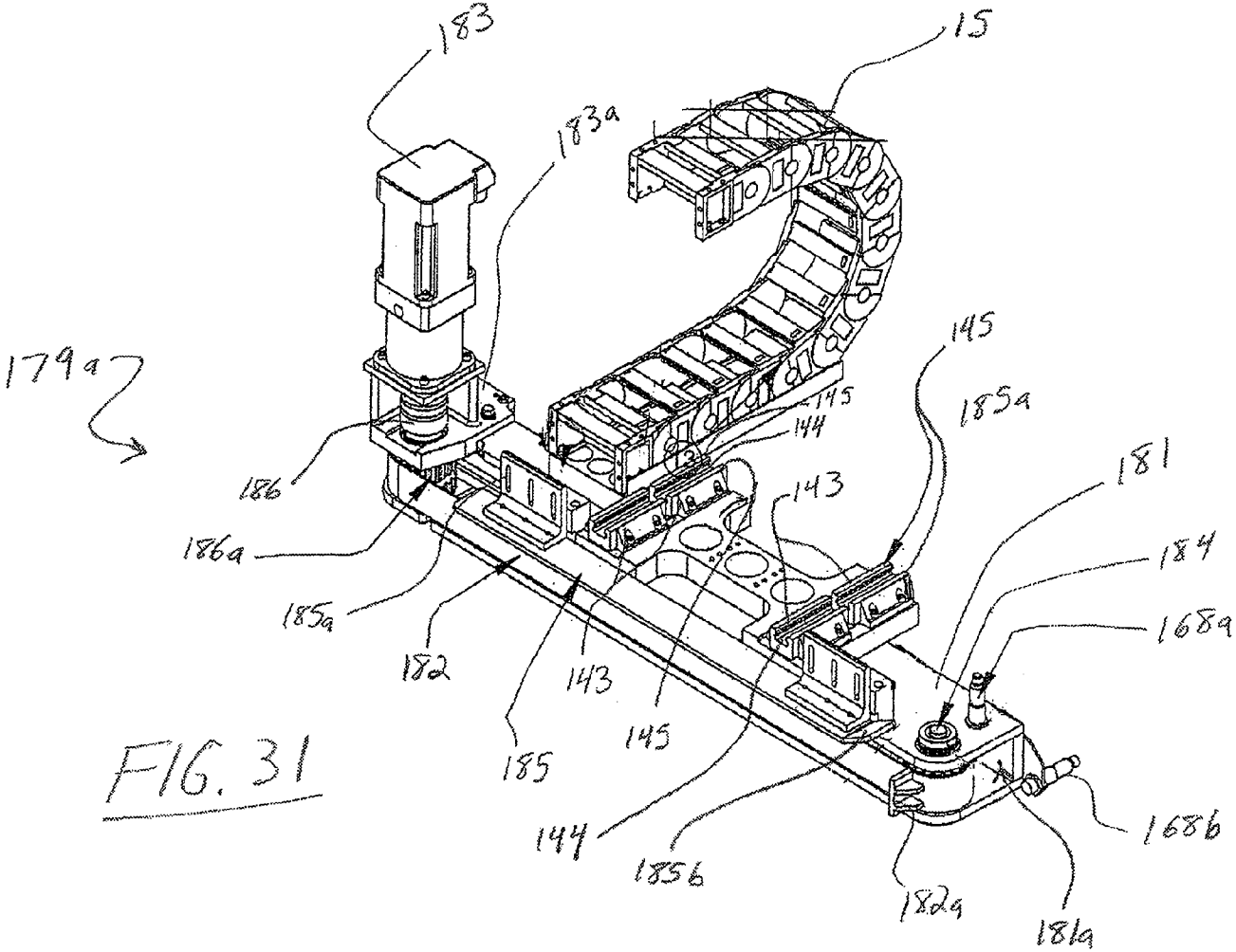
FIG. 31 is a perspective view of a belt assembly of the second cutting assembly of FIG. 25.

The moveable belt assembly 179*a*, shown in FIG. 31, also contains a set of sliding supports 143 fixed to the top surface of the housing 181*a*. These sliding supports 143 are similar in structure and function to the sliding supports 135 of the vertical carriage 125, and have lateral channels 144 with inward-facing flanges 145 that form a clamping arrangement. The clamping arrangement allows the sliding supports 143 to slidably grip onto the lateral linear bearing rails 139 on the vertical carriage 125, enabling the moveable belt assembly 179*a* to slide laterally along the bearing rails 139 to adjust the cutting width of the second cutting assembly 114. The servo motor 199*a* affixed to the vertical carriage 125 is operably connected to the moveable belt assembly 179*a* to slide the moveable belt assembly 179*a* along the bearing rails 139. The fixed belt assembly 179*b* is fixedly mounted to the belt mount 180 of the vertical carriage 125, so it does not contain any sliding supports.

The preferred belt drive system 178 includes three proximity sensors 168, two of which are located on the moveable belt assembly 179*a*, and one of which is located on the fixed belt assembly 179*b*. Each belt assembly 179 contains a cleat proximity sensor 168*a* that is mounted on the housing 181 so that the sensor 168*a* projects into the channel 181*a*. The cleat proximity sensor 168*a* senses when the cleat is near the entrance end of the belt assembly 179 and relays such information to the controller 16. Additionally, the belt drive system 178 has a container proximity sensor 168*b*, which is preferably mounted on the moveable belt assembly 179*a* but can alternately be mounted on the fixed belt assembly 179*b*. The container proximity sensor 168*b* detects when the container is near the entrance end of the belt drive system 178 and when the container 11 has completely entered the belt drive system 178 and relays such information to the controller 16. The information received from this combination of sensors 168 allows the controller to control rotation of the belts 182 so that the cleat 182*a* engages the rear of the container 11 with the proper timing. The proximity sensors 168 are preferably inductive sensors, but may alternately be a different type of sensor, such as laser sensors or sonic sensors.

Figure 32:
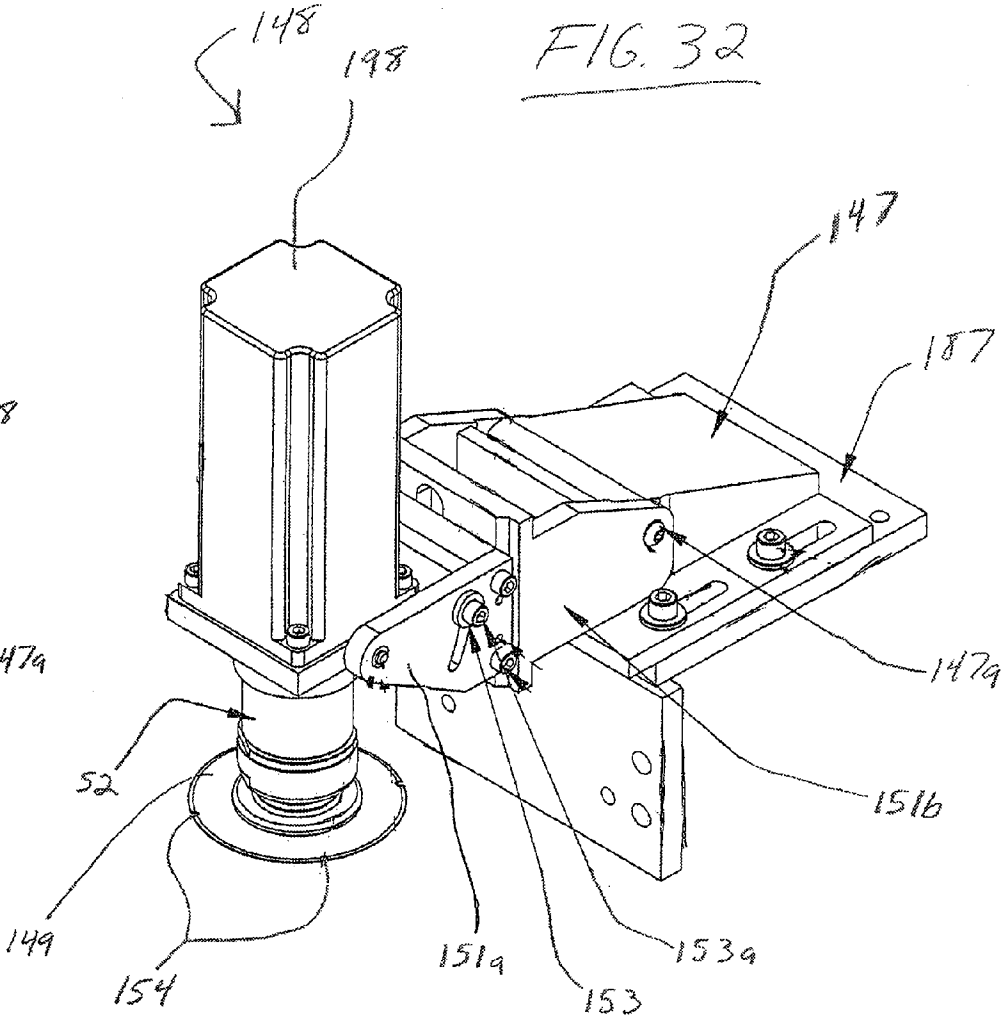
FIG. 32 is a perspective view of a blade assembly of the second cutting assembly of FIG. 25.
Figure 32A:
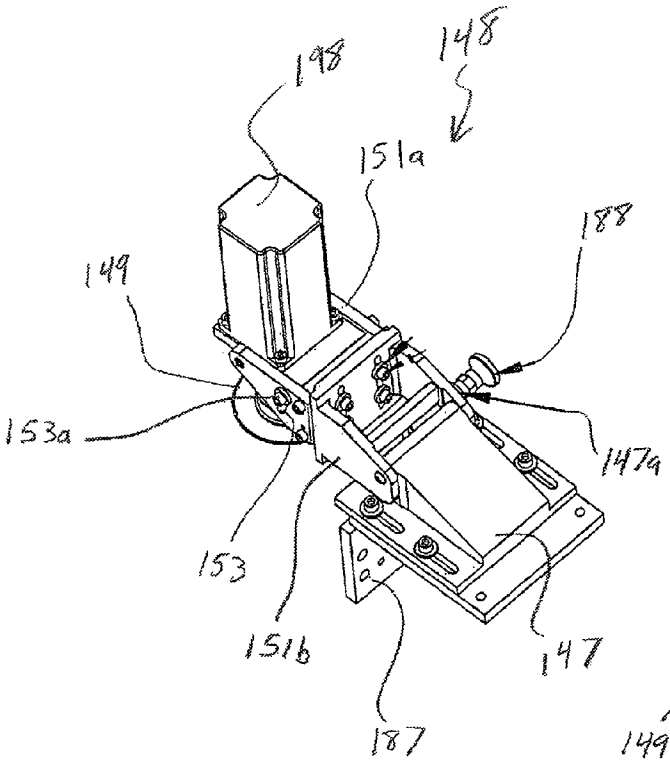
FIG. 32A is a rear perspective view of the blade assembly of FIG. 32.

The blade assembly 127 of the second cutting assembly 114 is shown in FIGS. 25 and 27, and illustrated in more detail in FIGS. 32-32A, and preferably includes two cutter heads 148. Each of the cutter heads 148 is fixed on one of the belt assemblies 179 and includes a cutting blade 149. Thus, in a preferred embodiment, the second cutting assembly 114 includes first and second cutter heads 148 and first and second cutting blades 149, which constitute third and fourth cutter heads 148 and third and fourth cutting blades 149 relative to the case cutter apparatus 10.

An example of a cutter head 148 is shown in FIGS. 32-32A and includes a servo motor 198, a mounting assembly 187, two pivoting mechanisms 151*a*, 151*b*, a connecting assembly 52, and a blade 149. The mounting assembly 187 is configured to be mounted on one of the belt assemblies 179 and to support the other components of the cutter head 148. The servo motor 198 provides power to the connecting assembly 52 to rotate the connecting assembly 52 and the blade 149 for the cutting operation. The servo motor 198 is mounted on each pivoting mechanism 151*a*, 151*b*, which is affixed to the mounting assembly 187. The first pivoting mechanism 151*a* allows the servo motor 198, along with the blade 149 and connecting assembly 52, to pivot, adjusting the cutting angle of the blade. In the preferred embodiment, the first pivoting mechanism 151*a* includes two slots 153 and two manually-adjustable pins 153*a* which slide in the slots 153 to allow freedom of movement. The second pivoting mechanism 151*b* is designed to allow the cutter head 148 to be completely raised out of the cutting zone. The second pivoting mechanism 151*b* contains a two-piece cutter mount 147 connected by a pin and bearing 147*a*, and the cutter mount 147 pivots about the pin and bearing 147*a*. A plunger mechanism 188 selectively prevents the cutter mount 147 from pivoting, and is selectively activated and deactivated by moving the plunger 188. Alternately, and similarly as discussed above, the blade assembly 127 could include an automated pivoting mechanism controllable by the controller to automatically adjust the cutting angle of the blade 149 or to automatically pivot the cutter head 148 out of the cutting zone.

The connecting assembly 52 preferably is a multi-piece assembly connecting the blade 149 to the motor 98 and includes a quick-connect/disconnect assembly 89, illustrated in FIGS. 14, 18, 33-38B, and 54-55, which is discussed in greater detail below. The blade 149 of the second cutting assembly 114 is preferably a disk with a sharp circular outer edge 149*b* and has four notches 154 positioned at regular intervals around the edge of the blade 149. In the embodiment shown in FIGS. 33-35, the notches 154 are positioned at 90° intervals. These notches 154 decrease blade wear and increase blade life. However, unlike the blade of the first cutting assembly 14, the blade 149 illustrated in FIGS. 33-35 does not include a circular guide washer 49*a*, since the blades 149 are preferably fixed in relation to the belts 182 and always cut at the same depth. Like the blades 149 of the first cutting assembly 14, the blades 149 of the second cutting assembly 114 preferably spin so that the portion of the blade 149 that is in contact with the container 11 is moving the same direction as the container 11. However, since the direction of movement is always the same, the blades 149 preferably always spin in the same direction.

The preferred power system 128 for the second cutting assembly 114 is shown in FIGS. 25-31 and 40. The power system 128 includes a vertical drive 155, a lateral drive 156, and a counterweight assembly 58, and is used to move the vertical carriage 125, and the moveable belt assembly 179*a*. The vertical drive 155 preferably includes a servo motor 199*b*, a connecting rod 159, and a coupler 160 at the tip of the connecting rod 159 for operably connecting to the retaining coupling 141 of the vertical carriage 125. The servo motor 199*b* for the vertical drive 155 is preferably mounted on the carriage support 124 and operates to extend and retract the connecting rod 159 to raise and lower the vertical carriage 125. The lateral drive 156 is operably connected to the moveable belt assembly 179*a* and contains a servo motor 199*a* mounted on the vertical carriage 125 for moving the moveable belt assembly 179*a* laterally to adjust the cutting width. The counterweight assembly 58 functions to minimize the force necessary to raise and lower the vertical carriage 125, and is discussed in greater detail below.

Figure 16:
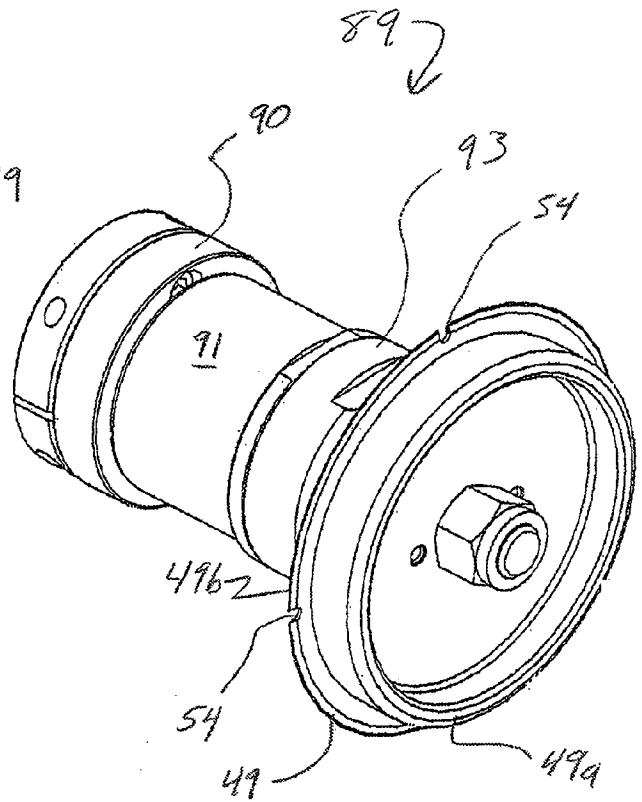
FIG. 16 is a perspective view of the connected blade and connecting assembly of FIG. 15.
Figure 15:
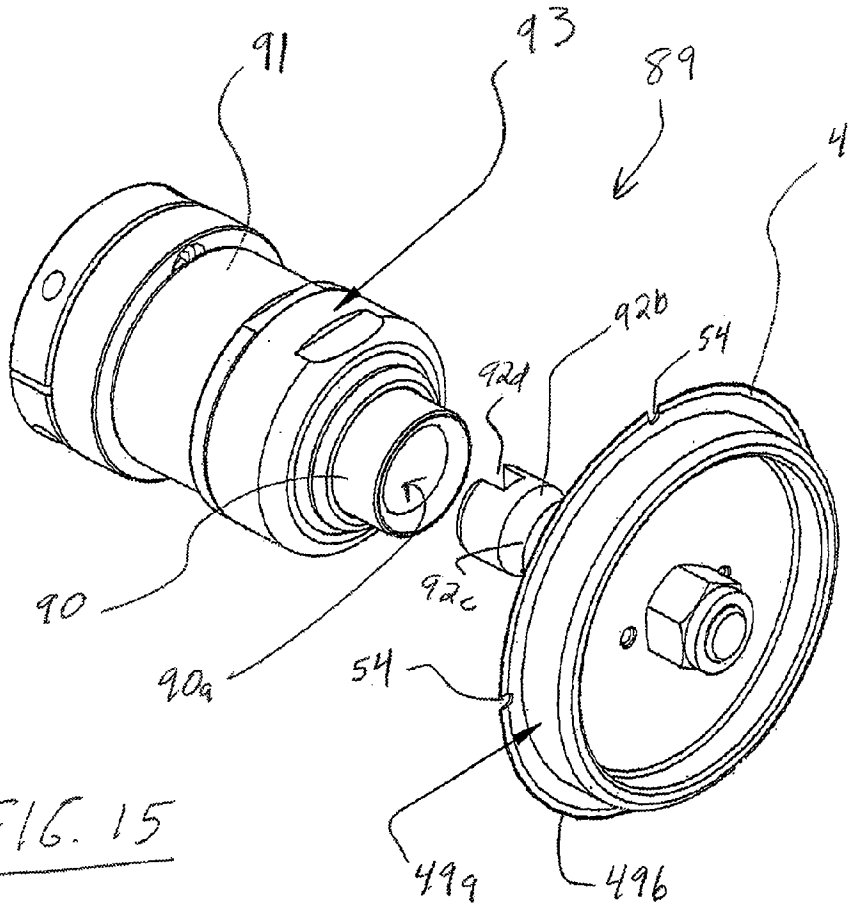
FIG. 15 is an exploded perspective view of a blade and a connecting assembly of the cutter head of FIG. 12, showing the connection therebetween.
Figure 17:
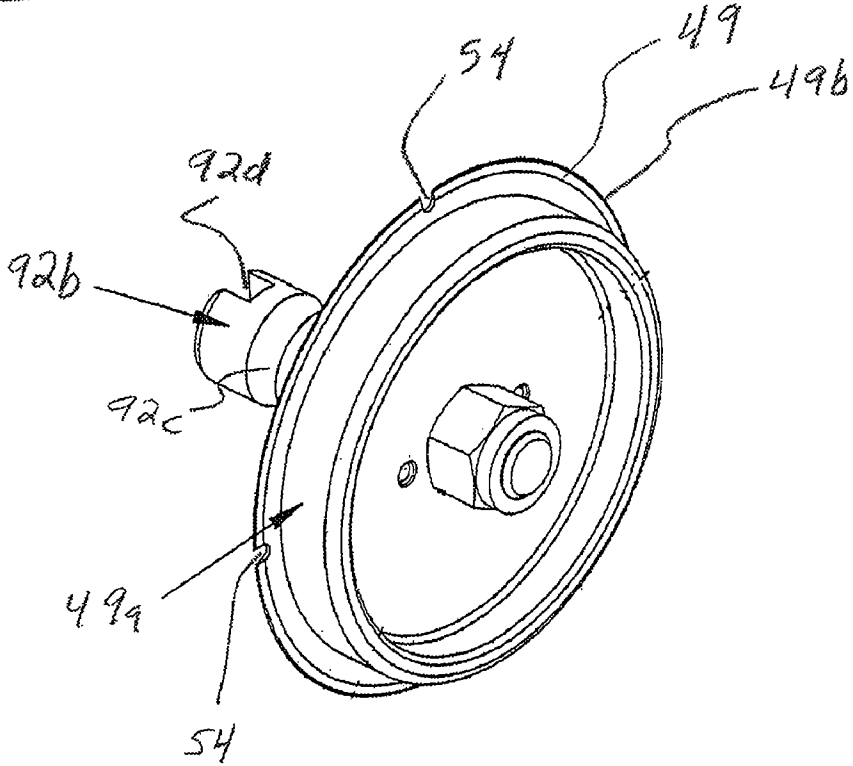
FIG. 17 is a perspective view of the blade and a portion of the connecting assembly of FIG. 15.
Figure 18:
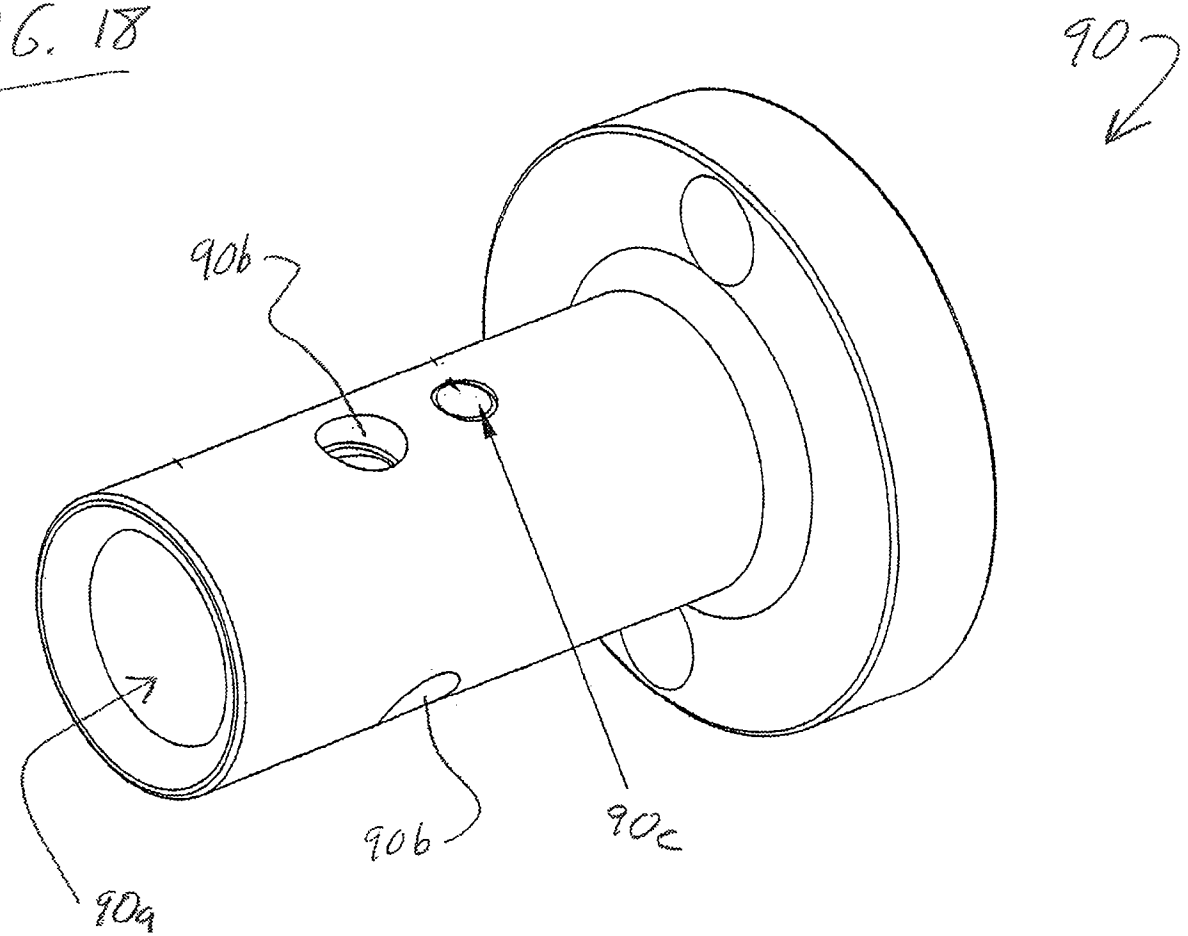
FIG. 18 is a perspective view of a portion of the connecting assembly of FIG. 15.

The preferred blades 49 used in the first cutting assembly 14 of the case cutter 10 are illustrated in FIGS. 15-17. As described above, the blade 49 of the first cutting assembly 14 preferably is circular and has four notches 54 positioned at 90° intervals around the edge of the blade 49. These notches 54 decrease blade wear and increase blade life. The blade 49 also preferably includes a circular guide washer 49*a* positioned at the bottom of the blade 49. The guide washer 49*a* abuts the wall of the container during cutting, limiting the depth that the blade 49 can cut and thus preventing the blade 49 from cutting too deeply into the container 11 and damaging the contents inside.

Figure 14:
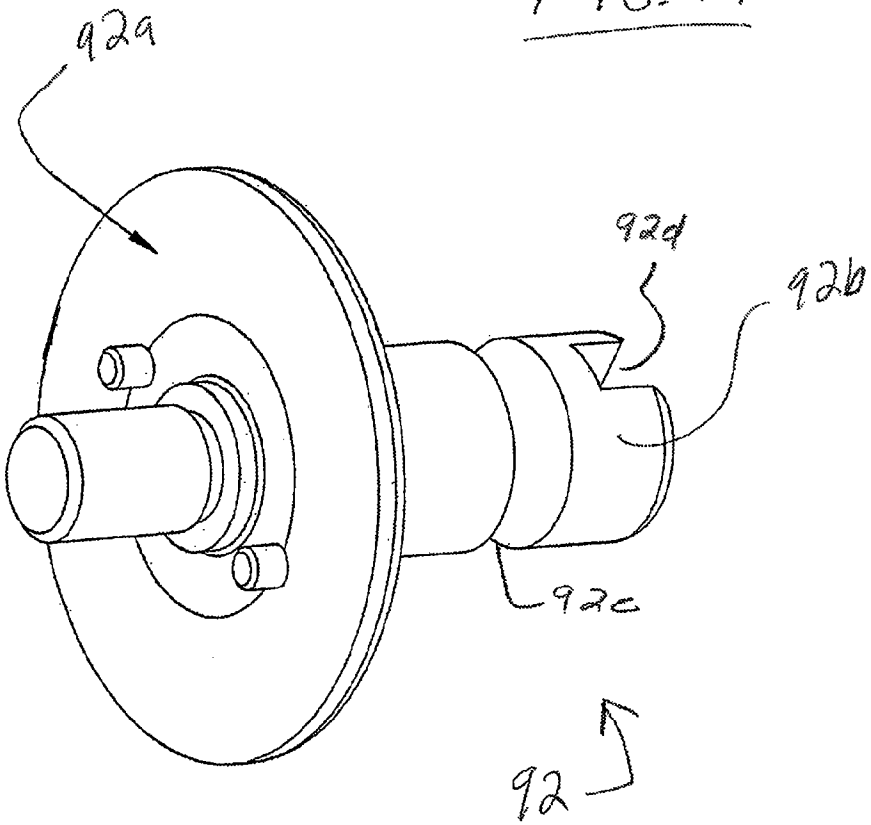
FIG. 14 is a perspective view of a spindle of the cutter head of FIG. 12.
Figure 35:
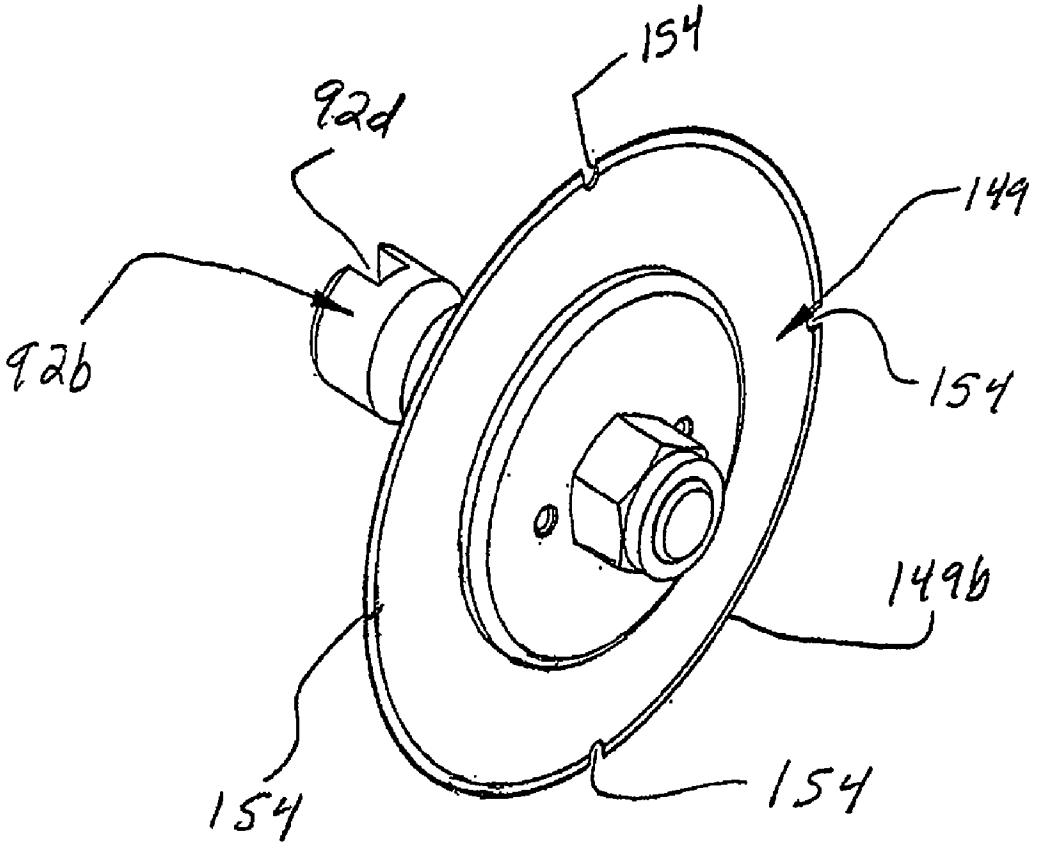
FIG. 35 is a perspective view of the blade and a portion of the connecting assembly of FIG. 33.
Figures 36, 37, 38, 38A, 38B:
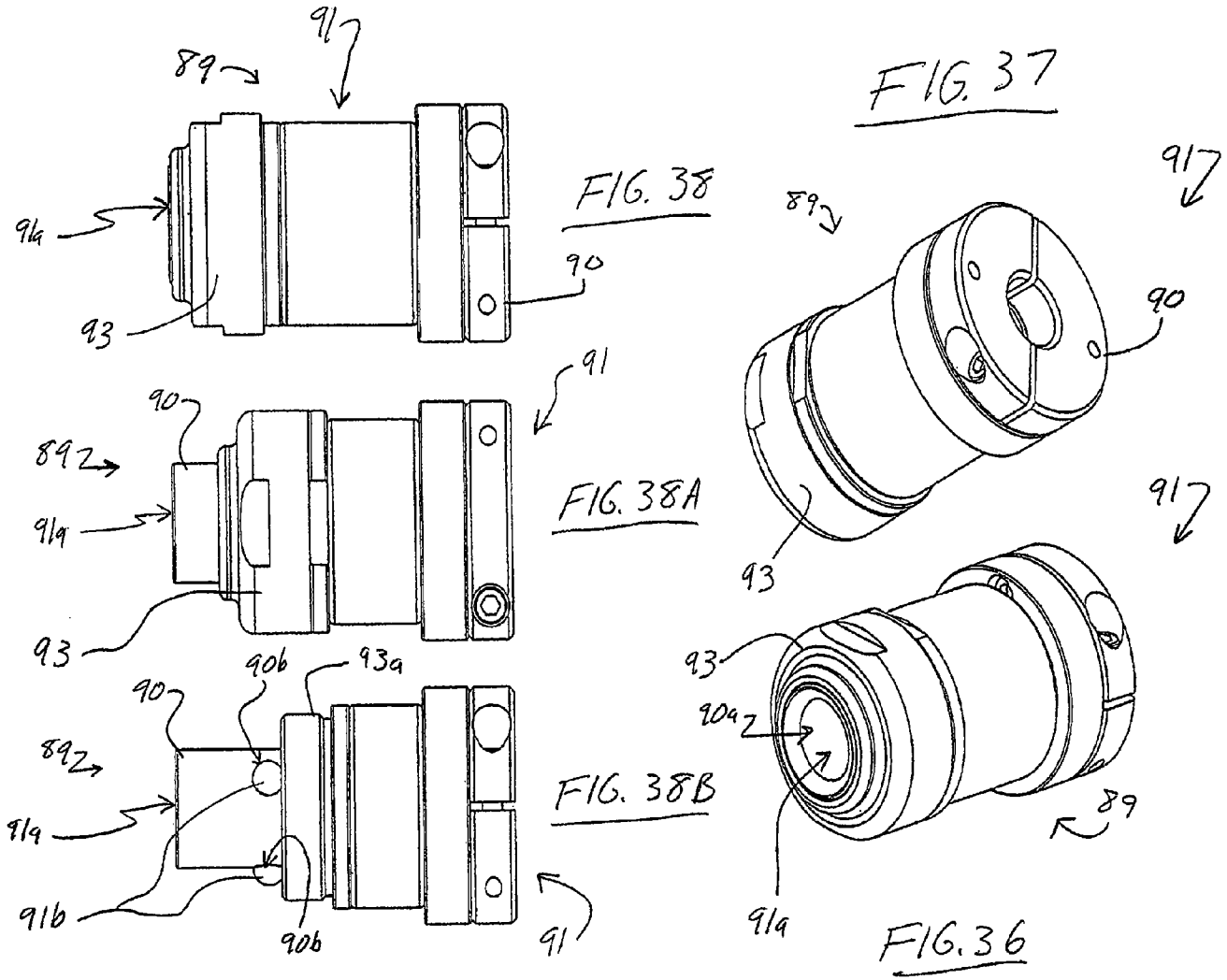
FIG. 36 is a perspective view of a portion of the connecting assembly shown in FIGS. 15 and 33.
FIG. 37 is a rear perspective view of the portion of the connecting assembly of FIG. 36.
FIG. 38 is a side view of the portion of the connecting assembly of FIG. 36 in a locked position.
FIG. 38A is a side view of the portion of the connecting assembly of FIG. 36 in an unlocked position.
FIG. 38B is a side view of the portion of the connecting assembly of FIG. 36 with a cap removed.
Figure 54:
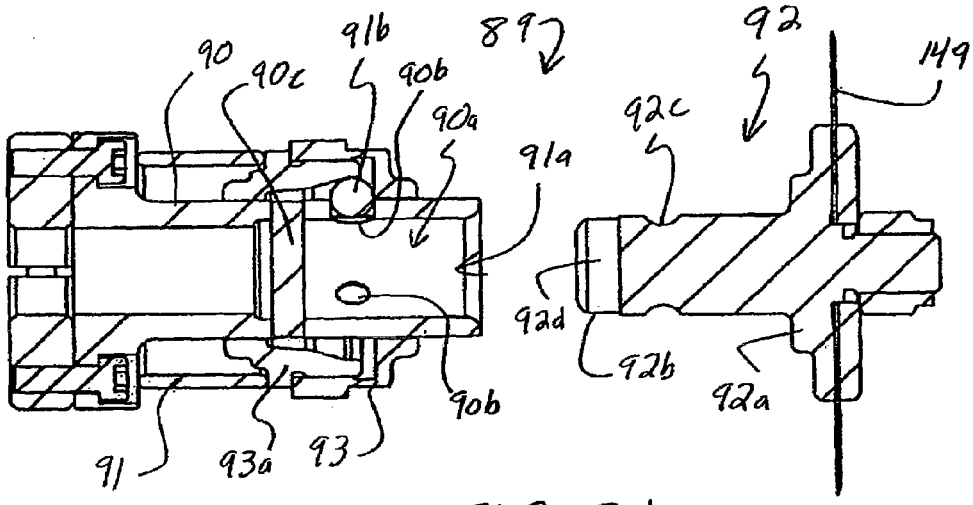
FIG. 54 is a cross-sectional view of the unlocked blade and connecting assembly of FIG. 33; and, FIG. 55 is a cross-sectional view of the locked blade and connecting assembly of FIG. 34.
Figure 55:
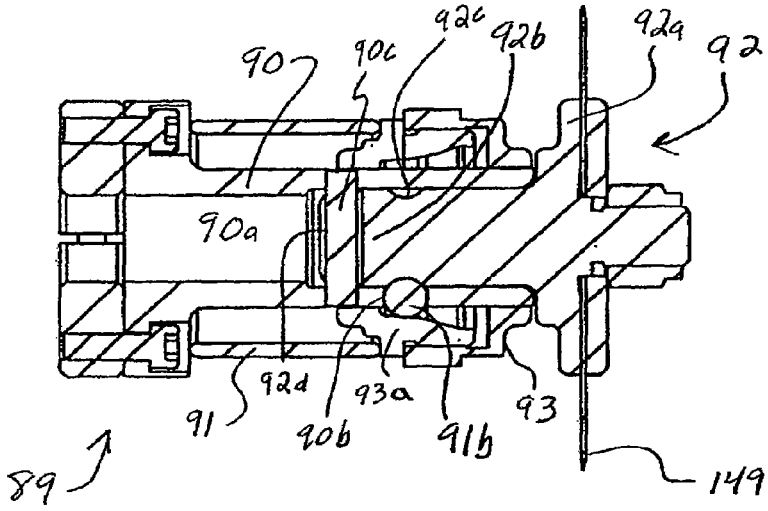

The preferred embodiment of the quick-connect/disconnect assembly 89 used in the first cutting assembly 14 and the second cutting assembly 114 is illustrated in FIGS. 14-18, 33-34, 36-38B, and 54-55, and includes a shaft 90, a locking housing 91, and a spindle 92, along with the blade 49. The shaft 90 is shown alone in FIG. 18, and has a hollow interior 90*a* defined by the cylindrical wall of the shaft 90, and a pin 90*c* extending therethrough. The locking housing 91, shown alone in FIGS. 36-38B, has an end opening 91*a*, several locking members 91*b* and a locking cap 93. The shaft 90 is inserted into the locking housing 91 and the locking cap 93 is placed over the end of the shaft 90. The locking members 91*b* are preferably locking balls 91*b* positioned within holes 90*b* in the wall of the shaft 90. The spindle 92, shown alone in FIG. 14, is elongated and preferably contains a mounting disk 92*a* at a first end and a knob 92*b* defined by an annular recess 92*c* at a second end thereof. The knob 92*b* also preferably has a groove 92*d* at the end thereof. The blade 49,149 is affixed to the disk 92*a*, as shown in FIGS. 17 and 35, and the knob 92*b* is inserted into the hollow interior 90*a* of the shaft 90, as shown in FIGS. 15-16, 33-34, and 54-55. Upon insertion of the spindle 92, the pin 90*c* is received in the groove 92*d* to prevent the spindle 92 from rotating independently of the connecting assembly 52. Then the locking cap 93 is slid downward to abut the locking balls 91*b* and force the locking balls 91*b* to abut the spindle 92 to lock the spindle 92 into the shaft 90, forming the quick-connect/disconnect assembly 89. Thus, the locking cap 93 is moveable between a first position (shown in FIG. 54), wherein the spindle 92 may be freely removed from the connecting assembly 52, and a second position (FIG. 55), wherein the cap 93 abuts the locking member 91*b*, forcing the locking member 91*b* to abut the spindle 92 and lock the spindle 92 within the connecting assembly 52. Preferably, the locking cap 93 is annular and includes an annular inner sleeve 93*a* that moves with the locking cap 93 and abuts the locking balls 91*b*, as illustrated in FIGS. 54-55. Also, the locking balls 91*b* preferably are received in the recess 92*c* of the spindle 92 and abut a portion of the knob 92*b* when in the locked position, as shown in FIG. 55. When the blade 49 needs to be changed, the locking cap 93 can be slid upward to release the locking balls 91*b* and unlock the spindle 92, and the spindle 92 and blade 49 can be quickly removed and replaced with a new spindle 92 and blade 49. This greatly decreases the time necessary for blade changing.

Figures 33, 34:
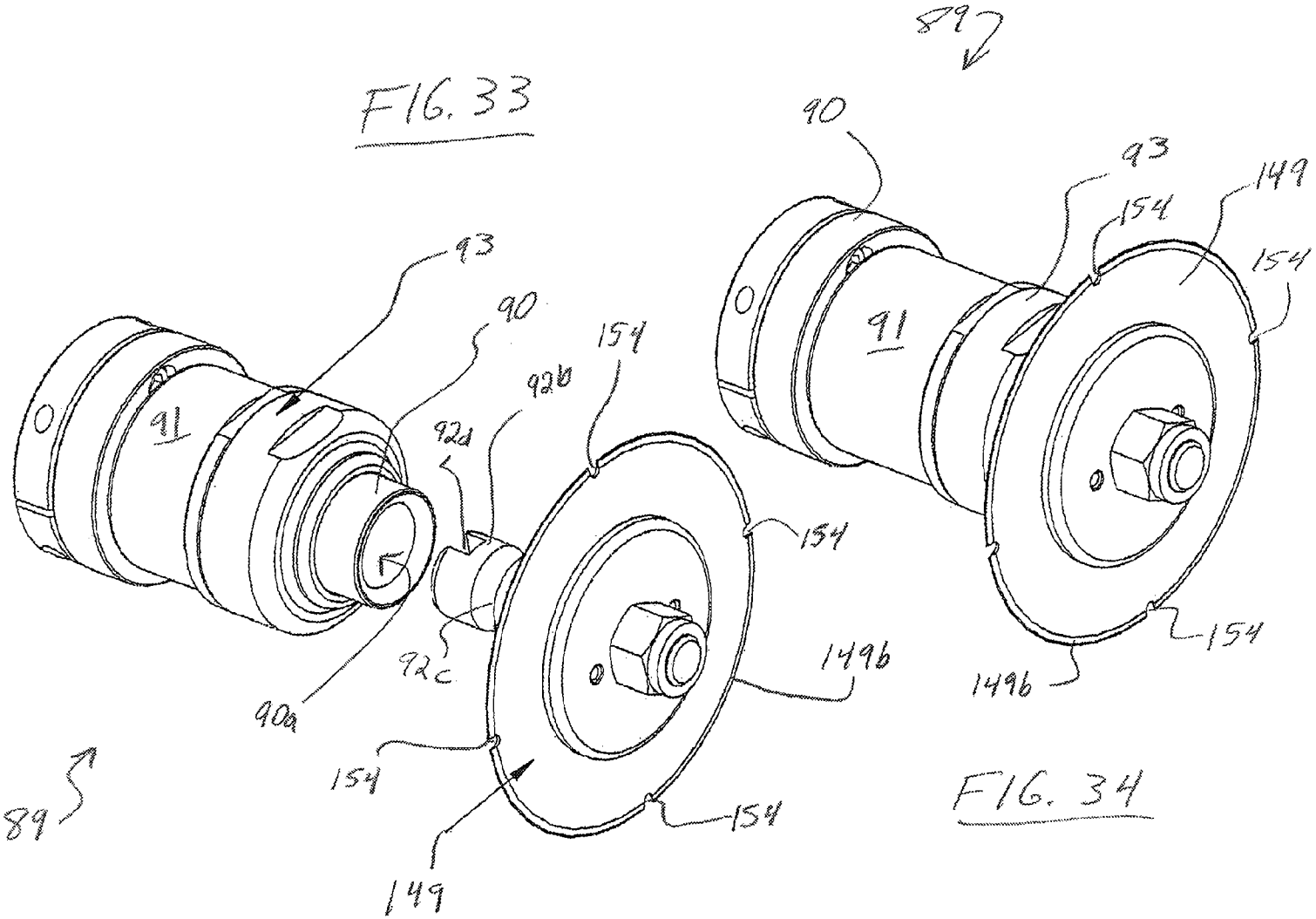
FIG. 33 is an exploded perspective view of a blade and a connecting assembly of a cutter head of the blade assembly of FIG. 32, showing the connection therebetween.
FIG. 34 is a perspective view of the connected blade and connecting assembly of FIG. 33.

The preferred blades 149 used in the second cutting assembly 114 of the case cutter 10 are illustrated in FIGS. 33-35. The blade 149 of the second cutting assembly 114 preferably is circular and has four notches 154 positioned at 90° intervals around the edge of the blade 149. These notches 154 decrease blade wear and increase blade life. However, unlike the blade of the first cutting assembly 14, the blade 149 illustrated in FIGS. 33-35 does not include a circular guide washer 49*a*, since the blades 149 are preferably fixed in relation to the belts 182 and always cut at the same depth. The quick-connect/disconnect assembly 89 of the blade 149 and connecting assembly 52 used in the second cutting assembly 114 is illustrated in FIGS. 33-35 and 36-38B, and is the same as the quick-connect/disconnect assembly 89 used in the first cutting assembly 14 except for the different blade.

The blades 49,149 are preferably made of high speed tool steel, which provides strength and holds an edge well. Alternately, other suitable materials may be used.

Figure 40:
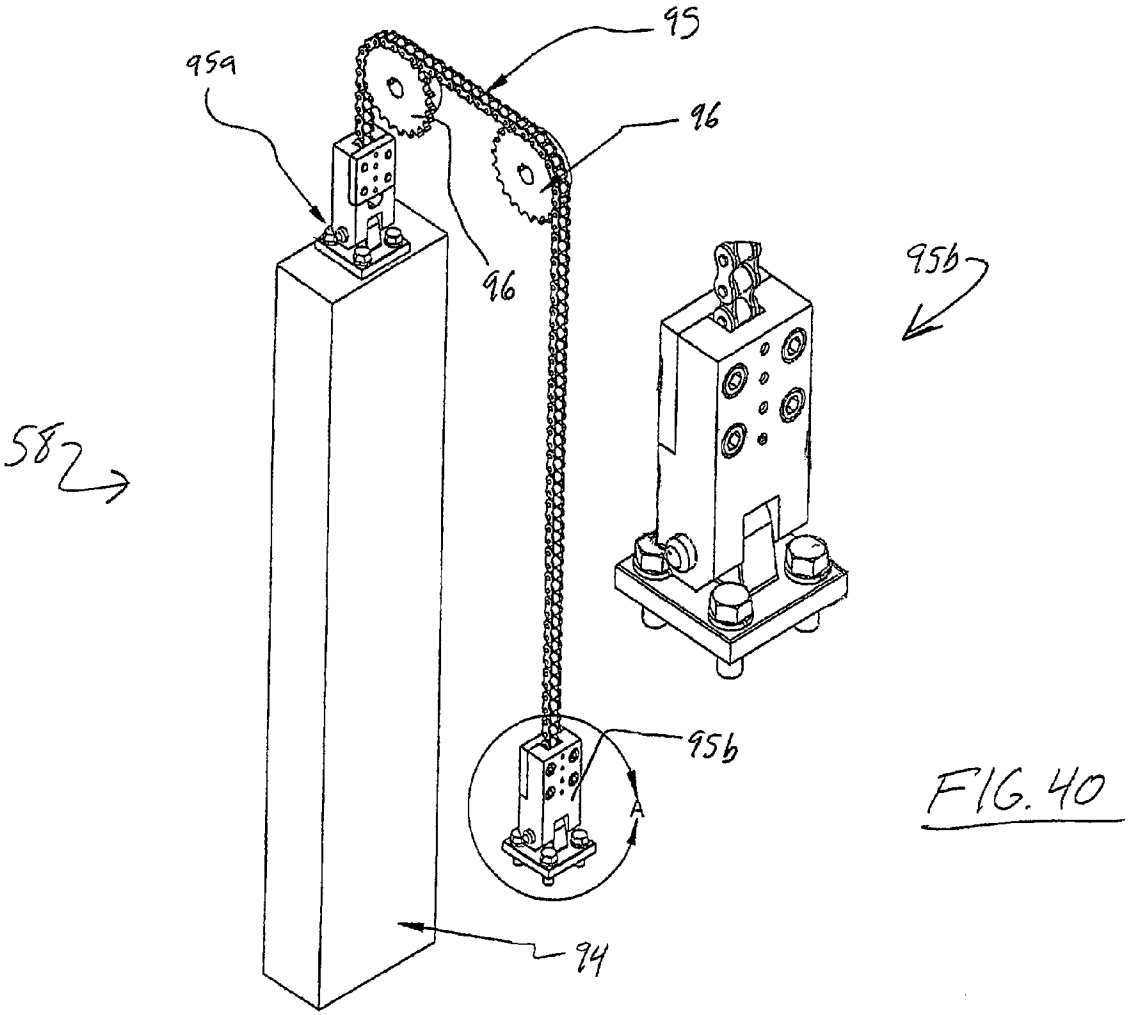
FIG. 40 is a perspective view of a counterweight assembly of the case cutter apparatus of FIG. 1.

The first cutting assembly 14 and the second cutting assembly 114 each preferably contain two counterweight assemblies 58 to facilitate raising and lowering of the vertical carriage 25,125. The counterweight assemblies 58 used in each cutting assembly are nearly identical, and an example of one is shown in FIG. 40. The counterweight assembly 58 contains a weight 94 connected to a chain 95 by a coupler 95*a*, two gears 96 which the chain 95 is wrapped around, and a second coupler 95*b* at the opposite end of the chain 95 for attachment to the vertical carriage 25,125. As shown in FIG. 26, the second cutting assembly 114 has two counterweight assemblies 58 located within the carriage support 124. The weights 194 are located within the vertical support members 132, and the gears 96 are located near the junctures of the vertical support members 132 and the horizontal support member 133. The chains 95 then extend downward to be connected to the vertical carriage 125. The first cutting assembly 14 also has two counterweight assemblies 58 that are configured in the same manner as those of the second cutting assembly 114. Additionally, as mentioned above, the weight 94 of the first cutting assembly 14 extends through the support structure 72 of the bracing mechanism 62.

The case cutter 10 preferably contains a computerized controller 16 with a visible display 16*a* for interaction with an operator. The controller 16 receives information from a plurality of sensors that sense different properties of the container and can automatically control the components of the case cutter 10 during the cutting operation based on these properties. Such sensors include the measuring device 13 and the proximity sensors 68,168. One action the controller 16 can take is controlling the cutting assemblies 14,114 to pre-position the components of the cutting assemblies 14,114 to accept a container 11 based on dimensional measurements from the measuring device 13. In other words, the controller 16 receives at least one dimensional measurement of a container 11 from the measuring device 13 and adjusts the cutting assembly 14,114 to accept the incoming container 11 based on the dimensional measurement(s). Pre-positioning operations are described in more detail below. The controller can also control operation of the case cutter 10 based on information from the proximity sensors 68,168, including slowing or stopping the conveyor 12, activating the stop mechanism 61, and adjusting the speed and position of the belts 182 of the second cutting assembly 114. Additionally, the controller 16 can allow for manual control of some or all operations. Further, the controller 16 can monitor operation and performance of different components of the case cutter 10.

One operation the controller 16 can perform is accelerating/decelerating the container 11 moving through the case cutter 10 by changing the conveyor 12 speed, if necessary. For example, slowing the container 11 may be necessary when a large difference exists between the size of one container and the following container, because the power systems 28,128 may take time to adjust the components of the case cutter 10 to the proper positions for cutting. This is particularly advantageous when a very large container is following a very small container. Additionally, the controller 16 can slow down the conveyor 12 when the proximity sensors 68 indicate that the container 11 is approaching the stop mechanism 61, so that the inertia of the container 11 does not cause it to bounce off the stop mechanism 61 and cause misalignment.

Another operation the controller 16 can perform is monitoring the use of the case cutter 10 to automatically schedule part replacements or periodic maintenance. For example, the controller 16 can record the total length of material cut (in linear feet) by each blade and notify an operator when a blade should be replaced to avoid failure.

Still another operation the controller 16 can perform is automatic shutdown of the case cutter 10 if an unsafe condition arises. For example, the controller can detect if any safety guards are disabled or any safety panels are opened and shut down the case cutter 10 in response.

Yet another operation the controller 16 can perform is automatic rejection of a container 11. For example, if the controller 16 detects that a container 11 is too small to be cut by the case cutter 10, the controller 16 may pass the container 11 along the conveyor 12 through the case cutter 10 without attempting the cutting operation.

Another component of the case cutter 10 is the cable protector 15. Cable protectors 15 are shown in FIGS. 1-7, 10-11, 25-28, and 31-32, and function to protect wires, cables, and other lines running through the case cutter 10. Preferably, these cable protectors 15 are long and chainlike in appearance, constructed of a series of pivotably-connected links that allow the cable protectors 15 to flex with the movement of the components of the case cutter 10.

FIGS. 42-53 illustrate the case cutter 10 processing containers 11. In FIGS. 42-47, the case cutter 10 is shown cutting containers 11 of relatively large size. In FIGS. 48-53, the case cutter 10 is shown cutting containers 11 of relatively small size. The structure of the case cutter 10 allows the case cutter 10 to constantly alternate from cutting containers 11 of relatively large size and small size.

The first cutting assembly 14 operates to cut two sides of a container 11 carried by the conveyor 12. As described above, the first cutting assembly 14 cuts the container 11 laterally, across the path or movement direction (D) of the conveyor 12. The conveyor 12 carries the container 11 to be cut into the first cutting assembly 14, where the indexing assembly 29 indexes the container 11 for cutting. The plate 65 of the stop mechanism 61 is raised through the gap 63 in the conveyor 12 to block the container's path and the proximity sensors 68 detect when the container 11 is stopped by the stop mechanism 61. The controller 16 receives this information from the proximity sensors 68 and activates the bracing mechanism 62 to further secure the container 11. The bar 73 is extended to push the container 11 against the bracing wall 76 and hold the container 11 in place for cutting. Once the container 11 is indexed, the cutting operation can begin. FIGS. 42-53 illustrate the indexing assembly 29 in position for bracing a container 11 for cutting. The stop mechanism 61 in the extended position, where the plate 65 is extended through the gap 63 and is abutting the container 11 during cutting, and the bracing mechanism 62 is in the extended position, where the bar 73 pushes the container 11 against the bracing wall 76 to hold the container 11 in place.

The controller 16 pre-positions the first cutting assembly 14 to accept the container 11 before the container 11 arrives. Using length (L) information from the measuring device 13, the controller 16 signals the longitudinal drive 57 to move the moveable cutter head 48*b* along the longitudinal bearing rail 46 of the lateral carriage 26 to the proper blade spacing for the desired cutting length. Additionally, using height (H) information from the measuring device 13, the controller 16 signals the vertical drive 55 to move the vertical carriage 25 along the vertical bearing rails 31 of the carriage support 24 to the correct cutting height so that the blades 49 cut the container walls at a certain distance from the top. It is understood that the controller 16 can be set such that the blades 49 can cut the container 11 at any desired distance from the top. FIGS. 42-44 and 47 show the first cutting assembly 14 positioned for cutting a container 11 of relatively large size, having a relatively large length (L), width (W), and height (H). The vertical carriage 25 is raised high and the moveable cutter head 48*b* is significantly spaced from the fixed cutter head 48*a* in preparation for cutting. FIGS. 48-50 and 53 show the first cutting assembly 14 positioned for cutting a container 11 of relatively small size, having a relatively small length (L), width (W), and height (H). The vertical carriage 25 is positioned low and the moveable cutter head 48*b* is close to the fixed cutter head 48*a* in preparation for cutting, in contrast to the case cutter 10 configuration shown in FIGS. 42-44 and 47.

After the first cutting assembly 14 is in position for cutting, the blades 49 are activated by the servo motors 98 and the lateral carriage 26 moves laterally along the lateral bearing rails 39 of the vertical carriage 25. The lateral motion of the lateral carriage 26 moves the blade assembly 27 to make lateral cuts across the side walls of the container 11. Preferably, the blades 49 rotate relative to the direction of movement of the lateral carriage 26, as described below and shown in FIGS. 23-24. Once the cutting operation is complete, the bracing mechanism 62 and the stop mechanism 61 retract to release the container 11 and allow the conveyor 12 to carry the container to the second cutting assembly 114.

Preferably, the first cutting assembly 14 is configured to allow for cutting in either lateral cutting direction (C), along a cutting axis (C') (See FIGS. 23-24). Thus, the lateral carriage 26 may move left to right through one cutting motion (FIG. 23) and remain in place until the next cutting motion, where it moves from right to left (FIG. 24). This eliminates the need for the lateral carriage 26 to be repositioned after every cutting motion, decreasing the time necessary for repetition of the cutting process. The cutting direction (C) and cutting axis (C') of the first cutting assembly 14 are transverse to the direction (D) of the conveyor movement. Additionally, the rotational direction of the blades 49 is preferably adjusted relative to the direction (C) of the cutting motion. As illustrated in FIGS. 23-24, the blades 49 rotate so that the portion of each blade 49 that is in contact with the container 11 is moving a direction opposite of the direction (C) of the lateral carriage 26 and the blade assembly 27. Put another way, the blades 49 rotate such that their rotation is "pushing" the lateral carriage 26 in the cutting direction (C), rather than resisting the movement of the lateral carriage 26. Thus, as shown in FIG. 23, when the blades 49 are moving left to right, the top blade 249 is rotating clockwise and the bottom blade 349 is rotating counterclockwise. Conversely, as shown in FIG. 24, when the blade assembly 27 is moving right to left, the top blade 249 is rotating counterclockwise and the bottom blade 349 is rotating clockwise.

After the container 11 leaves the first cutting assembly 14, the conveyor 12 carries the container 11 in a continuous direction to the second cutting assembly 114. The second cutting assembly 114 operates to cut two sides of a container 11 carried by the conveyor 12. As described above, the second cutting assembly 114 cuts the container 11 longitudinally, parallel to the path of the conveyor 12.

The controller 16 pre-positions the second cutting assembly 114 to accept the container 11 before the container 11 arrives. Using width (W) information from the measuring device 13, the controller 16 signals the lateral drive 156 to move the moveable belt assembly 179*a* along the lateral bearing rail 139 of the vertical carriage 125 to the proper spacing for the width of the container 11. Additionally, using height (H) information from the measuring device 13, the controller 16 signals the vertical drive 155 to move the vertical carriage 125 along the vertical bearing rails 131 of the carriage support 124 to the correct height so that the skis 185 ride on the top of the container 11 and the blades 149 cut the container 11 walls at a certain distance from the top. FIGS. 42 and 45-47 show the second cutting assembly 114 positioned for cutting a container 11 of relatively large size, having a relatively large length (L), width (W), and height (H). The vertical carriage 125 is raised high and the moveable belt assembly 179*a* is spaced wide from the fixed belt assembly 179*b* in preparation for cutting. FIGS. 48 and 51-53 show the second cutting assembly 114 positioned for cutting a container 11 of relatively small size, having a relatively small length (L), width (W), and height (H). The vertical carriage 125 is positioned low and the moveable belt assembly 179*a* is close to the fixed belt assembly 179*b* in preparation for cutting, in contrast to the case cutter 10 configuration shown in FIGS. 42 and 45-47.

When the second cutting assembly 114 has been properly positioned, the conveyor 12 carries the container 11 between the belts 182, and the skis 185 engage the top of the container 11. The belts 182 of the second cutting assembly 114 are also pre-positioned to be ready to accept the container 11 as soon as the container 11 is released from the first cutting assembly 14. Using the information from the proximity sensors 168, the controller 16 activates the belt drive motors 183 so the cleats 182*a* on the belt 182 grab and push the container through the second cutting assembly 114 and toward the rotating blades 149. The blades 149 cut the side walls of the container 11 as the container 11 is being pushed past by the belts 182. Preferably, the cutter heads 148 are not mounted at the end of the belt assemblies 179 so the belts 182 can continue to push the container 11 after the cut is complete. After the belts 182 push the container 11 out of the second cutting assembly 114, the conveyor carries the cut container 11 to the unloading end 12*b* of the case cutter 10 for unloading. The second cutting assembly 114 cuts the container in a cutting direction and along a cutting axis that are in line with, or coaxial with, the direction (D) of the conveyor, and transverse to the cutting direction (C) and cutting axis (C') of the first cutting assembly 14.

After the process is completed, it can be repeated on other containers in rapid succession. In fact, due in part to the automated controller 16 and sensors 68,168, the case cutter 10 can operate on several containers at once. The first cutting assembly 14 can be cutting one container while the second cutting assembly 114 is simultaneously cutting another container. Further, the instant a container leaves one of the cutting assemblies 14,114, the controller 16 can begin positioning the cutting assembly 14,114 for the next container. As discussed herein, the controller 16 preferably pre-positions the first and second cutting assemblies 14,114 for each container 11 based on measurements from the measuring device 13. Preferably, the cutting assemblies 14,114 do not return to a "home" position between containers. Rather, the cutting assemblies 14,114 begin pre-positioning as quickly as possible in preparation for the next container. This drastically increases the rate at which containers can be cut by the case cutter 10.

Figure 39:
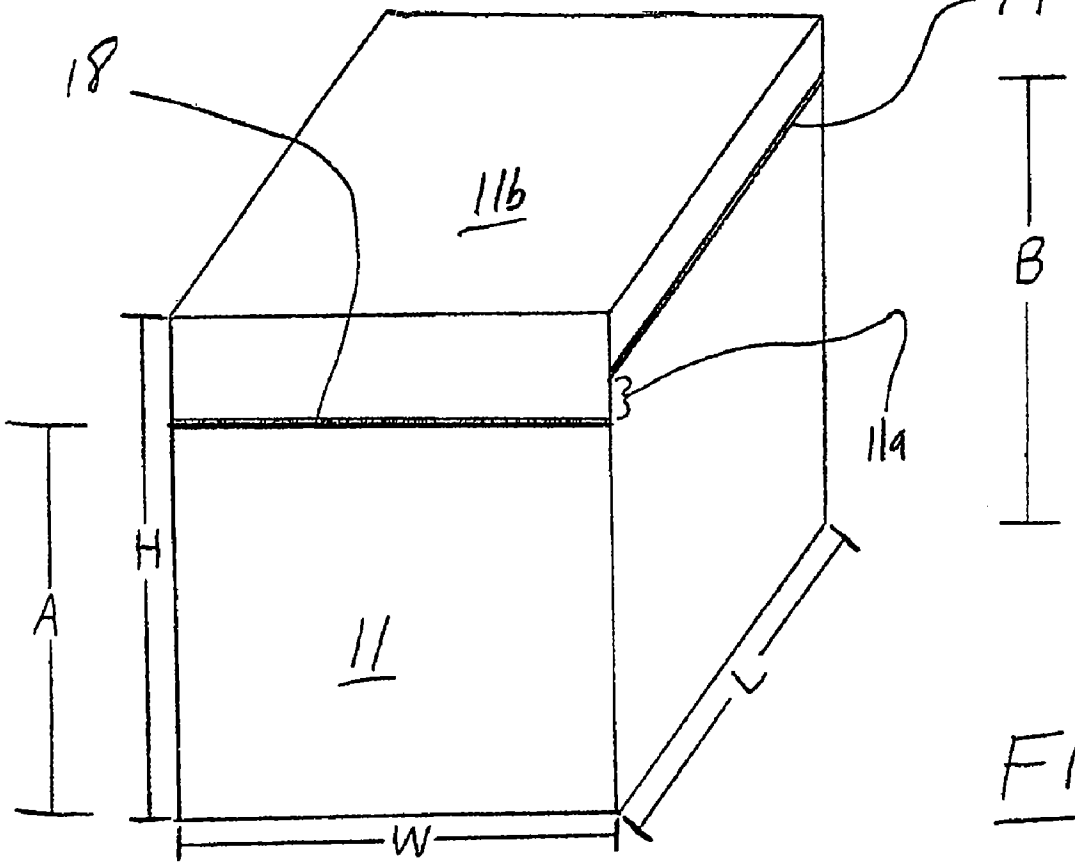
FIG. 39 is a perspective view of a container cut by the case cutter apparatus of FIG. 1.

FIG. 39 shows a container 11 that has been cut by the preferred embodiment of the case cutter 10. The container 11 has lateral cut lines 18 completely across the width (W) of the container 11 and longitudinal cut lines 19 completely across the length (L) of the container 11. The lateral cut lines 18 are staggered or offset from the longitudinal cut lines 19. In other words, the height (A) of the lateral cut lines 18 is different from the height (B) of the longitudinal cut lines 19, creating bridges 11*a* of uncut material to loosely connect the cut away portion 11*b* with the rest of the container 11. A worker unloading the container 11 can easily pull the cut away portion 11*b* from the container 11 by fracturing the bridges 11*a*. As shown in FIG. 39, the height (A) of the lateral cut lines 19 is lower than the height (B) of the longitudinal cut lines 19. However, the height (A) of the lateral cut lines 19 may be higher than the height (B) of the longitudinal cut lines 19 in an alternative embodiment. In another alternate embodiment, the case cutter 10 creates bridges by not cutting completely across the container wall, leaving a small piece of uncut material between the lateral cut lines 18 and the longitudinal cut lines 19. In this embodiment, the lateral cut lines 18 and the longitudinal cut lines 19 are generally aligned. In a further embodiment, the case cutter 10 cuts the top of the container 11 completely off.

Alternately, both cutting assemblies may cut the container 11 in the same direction. For example, both cutting assemblies may make lateral cuts across the container 11, or both cutting stations may make longitudinal cuts along the container 11 as it travels down the conveyor 12. In either instance, for the container 11 to retain a single direction of movement, the case cutter 10 must contain a turntable or other rotational indexing assembly to change the orientation of the container 11 between cutting operations. If both cuts are to be lateral, both cutting stations would preferably resemble the first cutting assembly 14 described above. Likewise, if both cuts are to be longitudinal, both cutting stations would preferably resemble the second cutting assembly 114 described above.

The case cutter 10 can also make angled cuts, which are useful if the container to be cut is not rectangular. In order to make an angled cut, the case cutter 10 uses a combination of the pivoting mechanisms 51, 151*a*, 151*b* to pivot the blades 49,149, and vertical movement of the carriages 25,125 during cutting.

Terms such as "first," "second," "third," "fourth," "upper," "lower," "length," "width," "height," "vertical," "horizontal,"

"longitudinal," "lateral," etc., are used herein for purposes of reference only, and are not intended to limit the claims in any way or designate any chronological relationship. This is particularly important with reference to the first cutting assembly 14 and the second cutting assembly 114. Thus, the case cutter 10 can alternately be arranged so the first cutting assembly 14 is located downstream from the second cutting assembly 114 and makes the final cut in the container 11, rather than the first cut. Further, the term "plurality," as used herein, indicates any number greater than one, either disjunctively or conjunctively, as necessary, up to an infinite number.

The present invention provides many benefits. Because the case cutter 10 moves the container in a single direction, on a single axis of movement, while cutting along two axes, the time for cutting is drastically decreased. No time needs to be taken for rotating the container or changing its direction of travel. Thus, the preferred embodiment can cut containers at an average speed of almost 3 seconds per container. Prior case cutting machines require an average of 6-10 seconds per container for cutting. Such prior art machines generally change the direction and axis of movement of the container between cutting operations. Additionally, the controller 16 permits the entire case cutter 10 to be automated, performing all major functions except maintenance and loading and unloading the containers from the apparatus. To this end, an automatic system could be employed to deliver containers to the loading end 12*a* of the conveyor.

While the specific embodiments have been illustrated and described, numerous modifications come to mind without significantly departing from the spirit of the invention, and the scope of protection is only limited by the scope of the accompanying Claims.

What is claimed is:

1. An apparatus for sequentially cutting a plurality of containers, each having a top, a bottom, and two pairs of opposed sides, the apparatus comprising:

a conveyor configured to move one or more of the containers at a variable non-stationary speed;

a cutting assembly positioned along the conveyor configured for cutting each container;

a sensor configured for measuring a dimension of each container;

a controller configured for controlling the apparatus, the controller in communication with the sensor, wherein the controller is configured to determine, based on the measured dimension of the container and a position of the cutting assembly, whether the non-stationary moving speed of the conveyor should be changed, and is further configured to automatically change the non-stationary moving speed of the conveyor while the conveyor is moving, based on the determination.

2. The apparatus of claim 1, further comprising a proximity sensor configured to measure a proximity of one of the containers to the cutting assembly, wherein the determination of the controller is further based on the proximity of the container to the cutting assembly.

3. The apparatus of claim 2, further comprising a moveable stop mechanism configured to stop the forward motion of one of the containers for cutting by the cutting assembly, and wherein the controller is configured to decrease the speed of the conveyor before the container reaches the stop mechanism, based on the proximity of the container to the cutting assembly, and to stop the forward motion of the conveyor when the container reaches the stop mechanism.

4. The apparatus of claim 1, wherein the determination of the controller is further based on the measured dimension of the one container compared to a measured dimension of a sequential container.

5. The apparatus of claim 1, wherein the controller is further configured to control stopping and starting movement of the conveyor.

6. An apparatus for cutting a container having a top, a bottom, and two pairs of opposed sides, the apparatus comprising:

a conveyor moving the container in a forward direction;

a cutting assembly positioned along the conveyor for cutting the container;

an indexing assembly configured for holding the container in a fixed position on the conveyor during cutting, the indexing assembly comprising a moveable stop mechanism to stop the forward motion of the container proximate the cutting assembly and a moveable bracing mechanism to prevent lateral movement of the container during cutting, wherein the stop mechanism comprises:

a mounting structure having two guides attached thereto, each guide having a slot therein, wherein the mounting structure and the guides are positioned below the top surface of the conveyor;

a moveable plate slidably mounted to the guides, wherein a portion of the plate is received in each slot; and an air cylinder having an extending rod coupled to the moveable plate, configured for moving the plate between a first position, wherein the plate extends through a gap in the conveyor and above the top surface of the conveyor to abut the front of the container, and a second position, wherein the plate does not extend above the top surface of the conveyor;

an arm attached to one of the guides of the mounting structure, the arm extending upward from the guide above the top surface of the conveyor; and a position detector affixed the arm such that the position detector is positioned above the top surface of the conveyor, the position detector configured to detect whether the container has reached the stop mechanism.

7. The apparatus of claim 6, wherein the bracing mechanism comprises a moveable bar abutting a first side of the container to prevent lateral movement of the container during cutting.

8. The apparatus of claim 7, wherein the bracing mechanism further comprises a bracing wall abutting a second side of the container, the bracing wall and the moveable bar cooperating to prevent lateral movement of the container during cutting.

9. The apparatus of claim 6, further comprising:

a controller configured for controlling the apparatus, the controller in communication with the proximity sensor, wherein the controller is configured to automatically change the speed of the conveyor in response to the proximity of the container to the stop mechanism.

10. The apparatus of claim 6, wherein the bracing mechanism comprises:

a support structure positioned adjacent to the conveyor;

a moveable bar slidably mounted on the support structure;

a bracing wall positioned adjacent to the conveyor; and an actuator configured for moving the bar between a first position, wherein the bar abuts the container and squeezes the container between the bar and the bracing wall to prevent lateral movement of the container during cutting, and a second position, wherein the bar does not abut the container.

11. The apparatus of claim 6, wherein the bracing mechanism comprises:

a support structure positioned adjacent a first side of the conveyor;

first and second bearing blocks mounted on the support structure;

first and second guide shafts, the first guide shaft held by the first bearing block in a sliding arrangement, and the second guide shaft held by the second bearing block in a sliding arrangement;

a moveable bar slidably mounted on the support structure and affixed to the first and second guide shafts;

a bracing wall positioned adjacent a second side of the conveyor, opposite the first side; and an actuator configured for moving the bar between a first position, wherein the bar abuts the container and squeezes the container between the bar and the bracing wall to prevent lateral movement of the container during cutting, and a second position, wherein the bar does not abut the container.

12. An apparatus for cutting a container having a top, a bottom, and two pairs of opposed sides, the apparatus comprising:

a conveyor configured for moving the container in a conveyor direction;

a measuring device configured for measuring a dimension of the container;

a first cutting assembly positioned along the conveyor and configured for cutting the container, the first cutting assembly comprising a first cutting blade and a second cutting blade positioned at a height from the conveyor, with a space defined between the cutting blades;

a controller configured for controlling the apparatus, the controller in communication with the measuring device, wherein the controller is configured to automatically pre-position the first cutting assembly by automatically adjusting at least one of the space between the cutting blades and the height of the cutting blades based on the dimension measured by the measuring device to place the blades in a cutting position before the container arrives at the cutting assembly, wherein the first cutting assembly is configured for cutting the container while in the cutting position.

13. The apparatus of claim 12, wherein the measuring device is configured for measuring a length of the container along the conveyor direction, wherein the first cutting assembly comprises first and second cutting blades moveable in a cutting direction generally transverse to the direction of the conveyor for cutting one pair of opposed sides of the container, and wherein the controller is configured to automatically pre-position the second cutting blade based on the measured length of the container.

14. The apparatus of claim 12, wherein the measuring device is configured for measuring a width of the container transverse to the conveyor direction, wherein the first cutting assembly comprises first and second belts positioned on opposed sides of the conveyor for pushing the container through the first cutting assembly and first and second cutting blades positioned on opposed sides of the conveyor for cutting one pair of opposed sides of the container, and wherein the controller is configured to automatically pre-position the first belt and the first cutting blade based on the measured width of the container.

15. The apparatus of claim 12, wherein the measuring device is configured for measuring a height of the container perpendicular to a surface of the conveyor, wherein the first cutting assembly comprises a carriage support structure, a vertical carriage mounted on the carriage support structure in a vertical sliding arrangement, and a cutting blade connected to the vertical carriage for cutting the container, and wherein the controller is configured to automatically pre-position the vertical carriage based on the measured height of the container.

16. The apparatus of claim 12, further comprising:

a second cutting assembly positioned along the conveyor a distance from the first cutting assembly and configured for cutting the container, wherein the first cutting assembly is configured for cutting a first portion of the container and the second cutting assembly is configured for cutting a second portion of the container, wherein the measuring device is configured for measuring a second dimension of the container, the second dimension being different from the first dimension, wherein the controller is configured to automatically pre-position the second cutting assembly into a second cutting position as the container is released from the first cutting assembly, based on the second dimension measured by the measuring device, and wherein the second cutting assembly is configured for cutting the container in the second cutting position.

17. The apparatus of claim 12, wherein when the first cutting assembly is in the cutting position, the space between the first cutting blade and the second cutting blade is approximately equal to the dimension measured by the measuring device.

18. The apparatus of claim 12, wherein no further adjustment of the height of the cuffing blades or the space between the cutting blades is necessary for cutting the container once the first cutting assembly is in the cutting position.

* * * * *